US005272300A

United States Patent [19]

Edamura

[11] Patent Number: 5,272,300

[45] Date of Patent: Dec. 21, 1993

[54] MICROWAVE OVEN WITH A MICROCOMPUTER OPERATED ACCORDING TO COOKING PROGRAMS STORED IN A MEMORY

[75] Inventor: Kaoru Edamura, Nara, Japan

[73] Assignee: Sharp Kabushiki Kaisha, Osaka, Japan

[21] Appl. No.: 690,866

[22] Filed: Apr. 24, 1991

[30] Foreign Application Priority Data

Apr. 26, 1990 [JP] Japan ..... 2-111063

[51] Int. Cl.[5] ..... H05B 6/68

[52] U.S. Cl. ..... 219/10.55 B; 219/10.55 A; 219/10.55 R; 219/506; 99/325; 364/477

[58] Field of Search ..... 219/10.55 B, 10.55 R, 219/10.55 F, 10.55 M, 10.55 E, 10.55 A, 506; 99/325, 451; 364/477

[56] References Cited

U.S. PATENT DOCUMENTS

| | | | |
|---|---|---|---|
| 4,255,639 | 3/1981 | Kawabata et al. | 219/10.55 B |
| 4,255,640 | 3/1981 | Bressler | 219/10.55 B |
| 4,336,569 | 6/1982 | Tsuda et al. | 219/10.55 B |
| 4,568,810 | 2/1986 | Carmean | 219/10.55 B |
| 4,621,178 | 11/1986 | Taguchi et al. | 219/10.55 B |
| 4,841,125 | 6/1989 | Edamura | 219/10.55 B |
| 4,972,060 | 11/1990 | Edamura | 219/10.55 B |

FOREIGN PATENT DOCUMENTS

| | | |
|---|---|---|
| 0329111 | 8/1989 | European Pat. Off. . |
| 0366137 | 5/1990 | European Pat. Off. . |
| 1-212827 | 8/1989 | Japan . |
| 2-118324 | 5/1990 | Japan . |

*Primary Examiner*—Bruce A. Reynolds
*Assistant Examiner*—Tu Hoang
*Attorney, Agent, or Firm*—Birch, Stewart, Kolasch & Birch

[57] ABSTRACT

A microwave oven has a control unit with a memory to control heat cooking process according to a cooking program for a menu name selected The control unit includes a liquid crystal display on which character data or image data are displayed as cooking information in plural display areas and a transparent electrode switch sheet in which are arranged plural transparent electrode switches. Keys of the control unit are formed by overlaying the transparent electrode switch sheet to the liquid crystal display such that each electrode switch of the overlaid transparent electrode switch sheet corresponds to the position of one of the plural display areas of the liquid crystal display. In the display area of each key is displayed the character information or image information stored as cooking information in the memory. When a user refers to the character information or image information shown in the display area of the key and operates the key required to select a desired menu name, the transparent electrode switch corresponding to the operated key operates, thereby executing a procedure corresponding to the character information or image information displayed in that display area, and the menu name desired by the user is selected.

9 Claims, 18 Drawing Sheets

4
SELECT DESIRED MENU
S13
DSPL FNSHED IMAGE
S14
CONFIRM DSPLD MENU ?
S15
NO
YES
PRESS CANC. KEY
S16
7
6
23
24
32
33
G-1 ××××
G-2 ××××
G-3 ××××
G-4 ××××
G-6 ××××
G-7 ××××
G-8 ××××
G-9 ××××
03
76
79
*G-3 Sirloin Steak
*Material : ... , ...
*Time : 35min.
*Calorie : Heavy
*Seasoning: ... , ...
GRILL
LOCK
CATE-GORY
CANCEL
80
*G-12 Sirloin Steak
*Material : ... , ...
*Time : 35 min
*Calorie : Heavy
*Seasoning: ... , ...
MENU
LOCK
MATE-RIAL
CANCEL
04
82

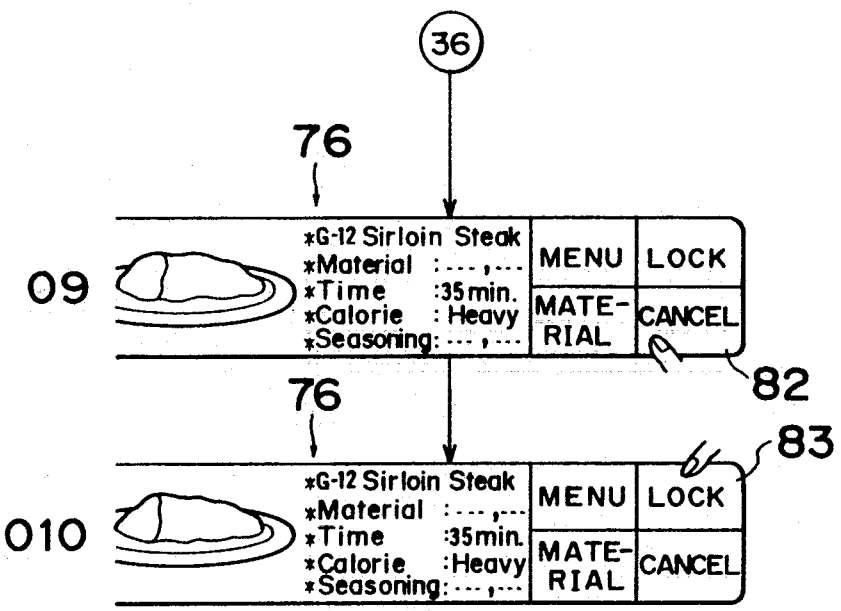
Fig. 6(h)
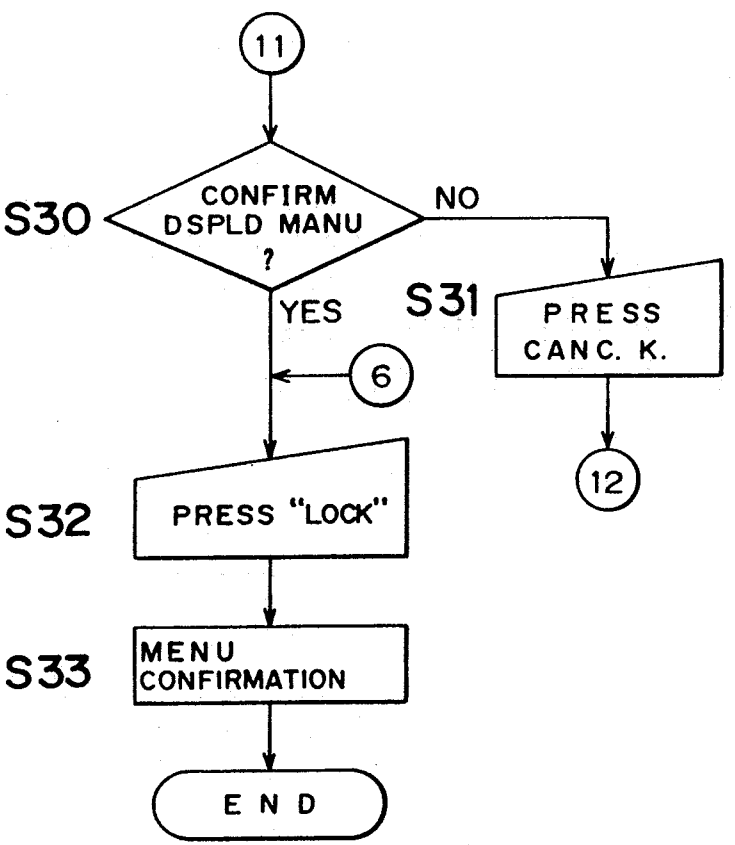

MICROWAVE OVEN WITH A MICROCOMPUTER OPERATED ACCORDING TO COOKING PROGRAMS STORED IN A MEMORY

BACKGROUND OF THE INVENTION

The present invention relates to a microwave oven which heats and cooks according to cooking programs stored in a memory.

As the range of heating functions of microwave ovens has been expanded, the number of usable cooking methods and the effective menu which can be prepared with a microwave oven have both been increased. As the cooking menu has been expanded, manufacturers have automated microwave oven operation by using microcomputers to control microwave cooking, convection heat cooking, and compound microwave-convention heat cooking functions, making microwave oven operation simple and easy. To make the use of these automated cooking options even easier, menu keys have been provided on a control unit as described below to enable the user to easily recall specific cooking programs from the various menus.

FIG. 7 is an external view of a conventional microwave oven with a control unit on which are provided menu keys, and FIG. 8 is an expanded view of the operating panel of the control unit 1 shown in FIG. 7. This operating panel comprises a display 2, primary menu keys 3, a cancel key 4, a heat switch 5, secondary menu keys 6, a heat mode selector 7, and a timer control 8. As shown in FIG. 9, the operating panel of the control unit 1 is constructed of an overlay 10 on which are imprinted the outlines and the names of the menu keys 3 and 6 and on the back side of which are provided the menu key contacts, a circuit board 13 on which are provided input switches, a membrane sheet 11 to assure a positive contact between the contacts on the overlay 10 and the input switch contacts on the circuit board 13 when the overlay 10 is pressed at specific points, and a spacer sheet 12.

However, because the menu keys 3 and 6 are provided within a limited space on the control unit 1 in the above conventional microwave oven, there is a limitation concerning the number of menu keys which can be provided on the panel in consideration of the operational ease of the menu keys 3 and 6 and the need to easily confirm the name of each key. If this limitation was ignored and the number of menu keys were increased, there would be a trouble to select one needed menu key due to the existence of a number of needless menu keys. That is, because only one menu key is always selected at a specific point by the user, the more selectable keys increase in number, the more the difficulty increases in selecting a menu key needed.

The inventor has previously proposed the microwave oven (Japanese patent laid-open publication No. 02-118324) described below as a means of resolving this problem.

This microwave oven categorizes many types of cooking menus by cooking mode (e.g., microwave cooking and grill cooking modes), and changes the menu names shown on the operating panel of the control unit as the cooking mode is changed. This means that only a few menu names are displayed at one time on the control unit, thus improving operability, the ease of menu key confirmation, and menu key selectivity.

FIG. 10 is an external view of the above proposed microwave oven, and FIG. 11 is an expanded view of the display panel on the control unit 15 therein. This display panel comprises a display 16, plural menu name displays 17, plural menu item selector switches 18, operating mode selector switch 19, and an operating mode display 20. The menu names stored in the menu name data area 21*d* in the operation control unit memory 21 provided in the control unit 15 as shown in FIG. 12 are categorized by cooking mode as described above and displayed by cooking mode in the menu name displays 17. At this time, the menu name information stored in the operation control unit memory 21 is categorized by menu category (e.g., Chinese cooking, Spanish cooking) and stored together with contents information, the cooking program, visual images of the menu selection, and other information in an IC card 22, RAM card 23, or other external data storage means. FIG. 13 shows the procedure to be followed when selecting a desired menu name from among plural menu names displayed in the display area of the control unit 15.

For example, if the user selects the IC card for Chinese cuisine and inserts this card into the slot of the microwave oven, the contents information is loaded into the contents data area 21*a* of the operation control unit memory 21, the cooking program into the cooking program area 21*b*, the menu image data into the menu image data area 21*c*, and the menu name data into the menu name data area 21*d*. Then, based on the contents data loaded into the contents data area 21*a*, the contents of the contents data (e.g., the menu categories or the number of menus in each cooking mode in the loaded IC card) displayed on the display 16 are displayed for easy confirmation by the user. Then, as shown in FIG. 13 (*a*), the operating mode changes to the clock mode, and the current time is displayed on the display 16.

If the operating mode selector switch 19 is pressed twice at this time, the operating mode passes through the MICROWAVE cooking mode shown in FIG. 13 (*b*) and enters the GRILL cooking mode as shown in FIG. 13 (*c*). If the menu item selector switch 18 for the menu name G-3 displayed in the menu name display 17 is then pressed, the menu image of the selected menu name G-3 is displayed in the display 16 as shown in FIG. 13 (*d*). If the user confirms that this is the desired menu selection and presses the menu item selector switch 18 again to confirm the selection, the cooking program for the menu name G-3 stored in the cooking program area 21*b* of the operation control unit memory 21 is loaded into the cooking controller section of the microwave oven. As shown in FIG. 13 (*e*), informations indicating that preparations for cooking according to the menu name G-3 are completed are on the display 16 and operating mode display 20, and the display then returns to the time display in FIG. 13 (*a*).

Plural menus can thus be stored by menu category in an IC card 22 or RAM card 23, and the user then loads the data on the IC card 22 or RAM card 23 of the desired menu category into the operation control unit memory 211. By thus displaying the menu names in the loaded data classified by cooking mode, operability, menu selection confirmation, and selectability can be improved in menu name selection.

However, in a microwave oven as thus described, at a stage when the user is unaccustomed to this operating procedure, the user is likely to be unfamiliar with the contents of the menus stored in the IC card 22 or RAM card 23. As a result, when the user has not had a concrete idea about what to prepare from among the available choices, it is necessary to select an IC card 22 or RAM card 23, select a cooking mode, select and confirm a menu name through a repeated process of trial and error in order to find what menus can be cooked by the control unit 15, thus requiring to user to make plural menu selections. In other words, this menu selection procedure is inappropriate when the user has not decided specifically what menu to prepare, or when the user is unfamiliar with the contents of the menus stored in the IC card 22 or RAM card 23.

The inventors have also proposed a microwave oven comprising a function unit 25 as shown in FIG. 16 Japanese patent laid-open publication No. 01-212827). This microwave oven displays an image of the finished dish prepared with plural menus selected by combining food materials specified by the user. The user then selects the desired menu by referring to the finished image of the plural menus shown on the display to set the cooking program of the selected menu.

FIG. 14 shows the top part of the control unit 26 provided on the front of the above microwave oven, and FIG. 15 is a partial cross section of the control unit 26. The function unit 25 is mounted inside the cover panel 27. FIG. 16 is an external view of the function unit 25 comprising a display 28, main materials input switches 29, and auxiliary materials input switches 30. This function unit 25 also comprises a data storage means, into which a sequence of cooking data is loaded from an external data storage means such as an IC card or RAM pack, and controls the menu selection operation based on this cooking data.

The menu selection operation of this function unit 25 is described below with reference to FIG. 17.

In FIG. 17 the operating procedure of the switches is shown on the right side, and the contents of the display appearing as a result of that switch operation are shown on the left side. When the menu selection mode switch 31 is pressed, the main materials indicators 32 flash to prompt the user to select the main materials. The user then refers to the printed illustrations of the main materials displayed in the main materials input switches 29 to find and press the switch for the main material used, "beef" in this example, thus, the selection of the main material to be used is completed. The selected main material indicator 33 for the selected material, "beef" then lights steady, indicating to the user that "beef" is selected.

The main materials information stored in the storage means of the function unit 25 are then retrieved to get the auxiliary materials information relating to the selected main material "beef", e.g., Chinese bamboo and Chinese cabbage in this example. The selected auxiliary materials indicators 34 for the found materials, Chinese bamboo and Chinese cabbage, then flash to prompt the user to make a selection. Referring to the printed images on the switches for auxiliary materials with their indicators flashing, the user then presses the auxiliary materials input switches 30 for desired auxiliary materials to make the selection. As a result, the controller then retrieves the available menus for menu selections which use the specified main material, "beef", and auxiliary materials, Chinese bamboo and Chinese cabbage, and shows on the display 28 an illustration of the finished menu selection found.

If there is no menu selection according to the material combination comprising beef, Chinese bamboo and Chinese cabbage, the reconstruction of the inputted materials combination is executed for the retrieval for the second time in a such manner that the combination of two subsidiary materials is disorganized, namely beef-Chinese bamboo, and beef-Chinese cabbage. In addition, it is not always necessary to select auxiliary materials for which the auxiliary materials are flashing in order to let the user to understand at a glance that some or all of those keys should be selected to couple with the main material for menu retrieval. Thus, in those cases in which an auxiliary materials input switch 30 for which the selected auxiliary materials indicator 34 is not blinking is selected, the controller will execute retrieval for menu according to only the main material selected.

As is clear from the descriptions given above, even when the user does not have any concrete idea about what to prepare or is unfamiliar with the contents of the menus stored in the IC card or RAM pack, the invention allow the user of menu selection according to the elements those can be handled by the user's subjective judgements such as like or dislike. Specifically, the materials selection out of printed illustrations on the material input switches 29, 30, and the menu selection out of the finished images illustrations on the display 28. Thus, a microwave oven as described above eliminates the problem that the user must select plural menus by a process of trial and error.

As thus described, a microwave oven with which main and auxiliary materials are specified and a menu selection is then made is particularly effective when the user does not have any concrete idea what to eat, or is not quite sure about the menus stored in the IC card or RAM pack. However, when selecting a menu which the user has made some choices previously, the user must still enter the main and auxiliary materials and then select the desired menu from among the plural menu choices retrieved according to the materials combination specified by him. In other words, the user have a concrete menu name of his desired menu, and he is sure about the contents of the IC card where the cooking information of the desired menu is stored. In spite of these knowledge available, the user will be forced to specify materials to be inputted and select the desired menu out of plural outputted menu images.

In addition, when the user is not quite sure about the subsidiary materials to be coupled or his specification is totally not correct, selection by trial and error or repeated operation is necessary. This means that the microwave oven described above does not allow the user to recall the menu information smoothly though he is quite sure about his desired menu name.

Moreover, because the illustrations of main materials are printed onto the main materials input switches 29, a given main materials input switch 29 cannot be assigned to another main material. As a result, it is not possible to handle extreme changes in cooking modes by replacing the IC card with which the main materials used may be very different. Furthermore, the size of the display 28 is relatively small compared to the size of the function unit 25. As a result, the illustrations of finished menu selections shown for the user on the display 28 have not satisfactory enough for stimulating the appetite for the displayed menu choices, and the menu selection operation is not made easy.

SUMMARY OF THE INVENTION

Therefore, an object of the present invention is to provide a microwave oven whereby a desired menu choice can be selected and set with a simple operation to achieve high menu selectability even when the menu is not decided in advance, the user is at a stage when the user has not sufficient knowledge about menu informations stored in the external memory means such as IC card and RAM pack due to lack of experience, and the user wishes to select a menu which has been previously used.

To achieve the aforementioned object, a microwave oven according to a first embodiment of the invention comprises a control unit with a memory to control heat cooking process according to a cooking program for a menu name selected based on cooking information stored in a memory, said cooking program being stored in a storage device in the microwave oven, wherein said control unit comprises:

a liquid crystal display, on which character data or image data are displayed as the cooking information stored in the memory in plural display areas formed continuously; and a transparent electrode switch sheet which is laminated with the liquid crystal display and comprises plural transparent electrode switches arranged at positions corresponding to the display areas of the liquid crystal display, whereby keys on a operating panel are respectively formed by one of the display areas of the liquid crystal display and one of the transparent electrode switches occupying the same area on the transparent electrode switch sheet as the one of the display areas.

In a second embodiment of the present invention, the memory of the microwave oven according to the first embodiment described above stores cooking information comprising at least menu selection mode names, menu names, and materials images;

the keys are assigned as at least an operation key for specifying the menu selection mode and plural selection keys for specifying the menu name or materials; and the control unit comprises:

a menu selection mode setting means which changes, based on display contents of a display area of the operation key when the operation key is operated, the menu selection mode between a menu name listing selection mode wherein a menu is selected from a menu name list and a material specification selection mode wherein a menu is selected by specifying materials;

a key display means which, when the menu name listing selection mode is set by the menu selection mode setting means, displays the menu names stored in the memory to display areas of the plural selection keys, and displays to the display area of the operation key the menu selection mode name associated with the menu name listing selection mode, and when the material specification selection mode is set by the menu selection mode setting means, displays illustrations of available material choices to the display areas of the plural selection keys, and displays to the display area of the operation key the menu selection mode name associated with the material specification selection mode; and a menu selection means which selects a specified menu name from among the menu names stored in the memory based on the menu name displayed in the operated selection key when the menu name listing selection mode is set by the menu selection mode setting means, and based on a material illustration displayed in the operated selection key when the material specification selection mode is set by the menu selection mode setting means.

According to a third embodiment of the present invention, in a microwave oven according to the second embodiment, the cooking information stored in the memory includes finished images of each menu; and the key display means lets the display areas associated with plural mutually adjacent keys function as a single finished image display screen when a specific menu is selected by the menu selection means, and reads the finished image for the selected menu name from the memory for display to this finished image display screen.

According to a fourth embodiment of the present invention, a microwave oven according to the second embodiment of the invention comprises an external storage means to which is registered cooking information including at least the menu selection mode names, menu names, and material images for storing to the memory, and wherein the control unit includes:

a loading portion into which is loaded the external storage means; and a cooking information transfer means which transfers the cooking information registered in the external storage means to the corresponding area in the memory when the external storage means is loaded into the loading portion of the control unit.

Furthermore, in a fifth embodiment of a microwave oven described above, the control unit comprises the display area of the liquid crystal display across a complete width of its operating panel, and the side of the operating panel forms part of the contour of the microwave oven.

In the first embodiment of the invention, the keys of the control unit are formed by overlaying the transparent electrode switch sheet to the liquid crystal display such that each electrode switch of the overlaid transparent electrode switch sheet corresponds to the position of one of the continuously formed plural display areas of the liquid crystal display. In the display area of each key is displayed the character information or image information stored as cooking information in the memory of the control unit.

Therefore, when the user refers to the character information or image information shown in the display area of the key and operates the key required to select the desired menu name, the transparent electrode switch of the operated key operates, thereby executing the procedure corresponding to the character information or image information displayed in that display area, and the menu name desired by the user is selected.

In the second embodiment of the invention, cooking information consisting of at least the menu selection mode name, menu names, and material images is stored in the memory of the microwave oven according to the first embodiment. Moreover, the keys are assigned as at least an operation key to specify the menu selection mode, and plural selection keys to specify the menu or materials. When the operation key is operated, the menu selection mode is changed by the menu selection mode setting means between the menu name listing selection mode and the material specification selection mode based on the display contents of the display area for the operated operation key.

Then, when the menu name listing selection mode is set by the menu selection mode setting means, the key display means displays the menu names stored in the memory to the display areas of the plural selection keys and the menu selection mode name stored in the memory and associated with the menu name listing selection mode to the display area of the operation key. However, when the material specification selection mode is set, the key display means displays to the display areas of the plural selection keys illustrations of the available material choices stored to memory, and displays to the display area of the operation key the menu selection mode name associated with the material specification selection mode. Then, when the menu name listing selection mode is selected, a specific menu name is selected by the menu selection means from among the menu names stored in the memory based on he menu name displayed in the display area of the operated selection key. When the material specification selection mode is set, a specific menu name is selected by the menu selection means from among the menu names stored in the memory based on the material image displayed at the operated selection key.

Thus, the menu selection mode is changed between the menu name listing selection mode and the material specification selection mode by operating the operation key, and a menu can be selected by the user from the best menu selection mode for the user.

According to a third embodiment of the present invention, the cooking information stored in the memory of the microwave oven according to the second embodiment also include images of the finished menu selections. Then, when a specific menu is selected by the menu selected means, the key display means defines the display area of plural adjacent keys as a continuous finished image display area, and reads from memory for display thereto the finished image of the selected menu name.

Thus, by displaying to a large display area the finished image of the selected menu name, the ease of user menu confirmation operation is improved.

In a fourth embodiment of the present invention, the external storage means, to which is registered the cooking information consisting of at least the menu selection mode names, menu names, and material images, is loaded in the loading portion of the control unit. The cooking information registered in the external storage means is then transferred to the corresponding memory area by the cooking information transfer means. Thus, by changing the loaded external storage means, the material image used in the menus registered in the installed external storage means is displayed in the selection keys after the storage means is changed.

BRIEF DESCRIPTION OF THE DRAWINGS

The present invention will become more fully understood from the detailed description given below and the accompanying diagrams wherein.

DESCRIPTION OF PREFERRED EMBODIMENTS

Figure 1:
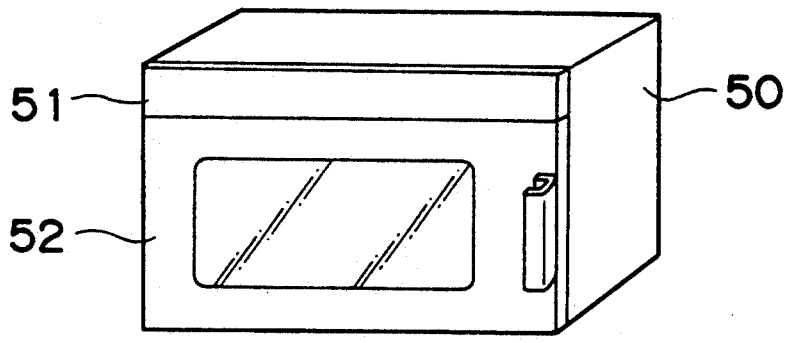
FIG. 1 is an external view of an embodiment of a microwave oven according to the present invention.
Figure 2:
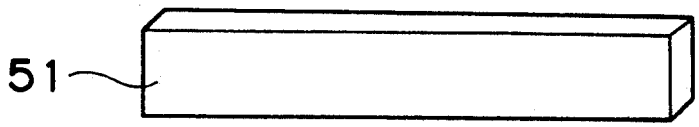
FIG. 2 is an enlarged schematic view of the control unit in FIG. 1.

A preferred embodiment of the present invention is described hereinbelow with reference to the accompanying figures, wherein FIG. 1 is an external view of a microwave oven according to the invention. This microwave oven comprises a magnetron to radiate microwaves to the materials for heat cooking on the oven tray, and an electric heater for conventional heating of the materials, though those are not shown in figures, and heat cooking is accomplished by either microwave heating or electric heater heating. Furthermore, as shown in FIG. 1, a control unit 51, which is a long, rectangular box shape as shown in FIG. 2, is provided across the full width of the microwave oven body 50 above the oven door 52 at the front of the microwave oven body 50.

Figure 3:
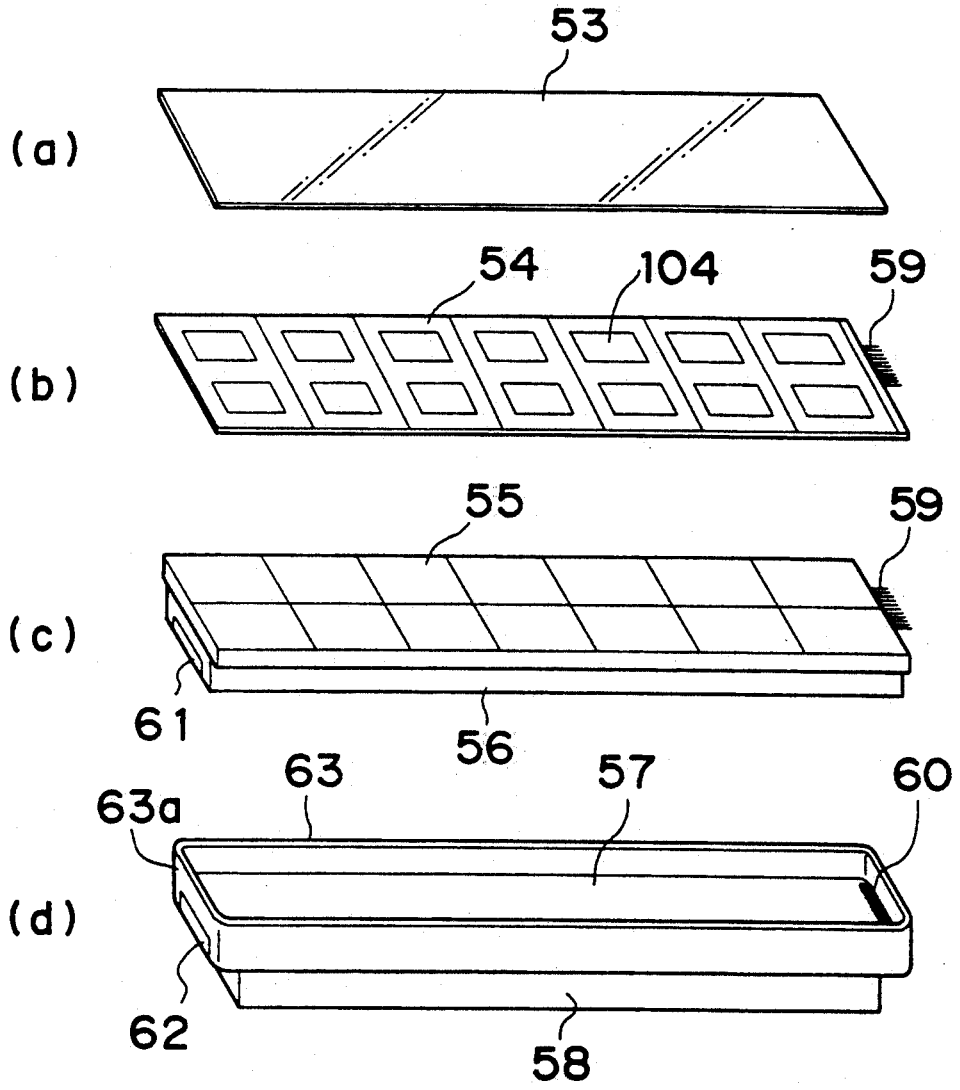
FIG. 3 is an exploded view of the control unit.

FIG. 3 is an exploded view of the control unit 51. This control unit 51 is formed by two main components, a display unit and a control unit controller 58. The display unit comprises an overlay 53, transparent electrode switch sheet 54) color LCD 55, and display controller 56 in a laminated construction.

The overlay 53 shown in FIG. 3 (*a*) is a transparent sheet on the surface of which nothing is printed. The transparent electrode switch sheet 54 shown in FIG. 3 (*b*) has fourteen transparent electrode switches 104, which are operated for menu selection, material selection, or function selection.

The color LCD 55 shown in FIG. 3 (*c*) displays on the LCD screen all character information or image information to be displayed on the control unit 51 by means of the display controller 56. One end of the leads 59 is connected to the terminals at the right end of the display controller 56, and the other end is connected to the terminals provided at the right end of the transparent electrode switch sheet 54. When the assembled display unit in lamination is mounted in the control unit panel 57 shown in FIG. 3 (*d*), the terminals (not shown in the figures) provided at the right end on the bottom of the display controller 56 are connected with the terminals 60 provided at the right end of the control unit panel 57. Thus, the display controller 56 controls the color LCD 55 to display the character information or image information according to the video signals or character signals from the control unit controller 58 provided on the bottom of the control unit panel 57. On the other hand, the selection/command signals from the transparent electrode switches 104 provided on the transparent electrode switch sheet 54 are sent to the control unit controller 58 through the display controller 56.

An insertion slot 61 is provided at the left end of the display controller 56 in the figure for an IC card used as an external storage means. The side 63*a* of the edge 63 of the control unit panel 57 forms part of the contour of the microwave oven body 50, with an insertion slot 62 provided in the side 63*a* thereof. When an IC card is inserted into this insertion slot 61, the contacts on the end of the IC card and the contacts provided at the inside end of the insertion slot 61 connect, and the cooking information stored in the IC card is loaded into the main memory of the control unit controller 58, which is RAM.

Figure 4:
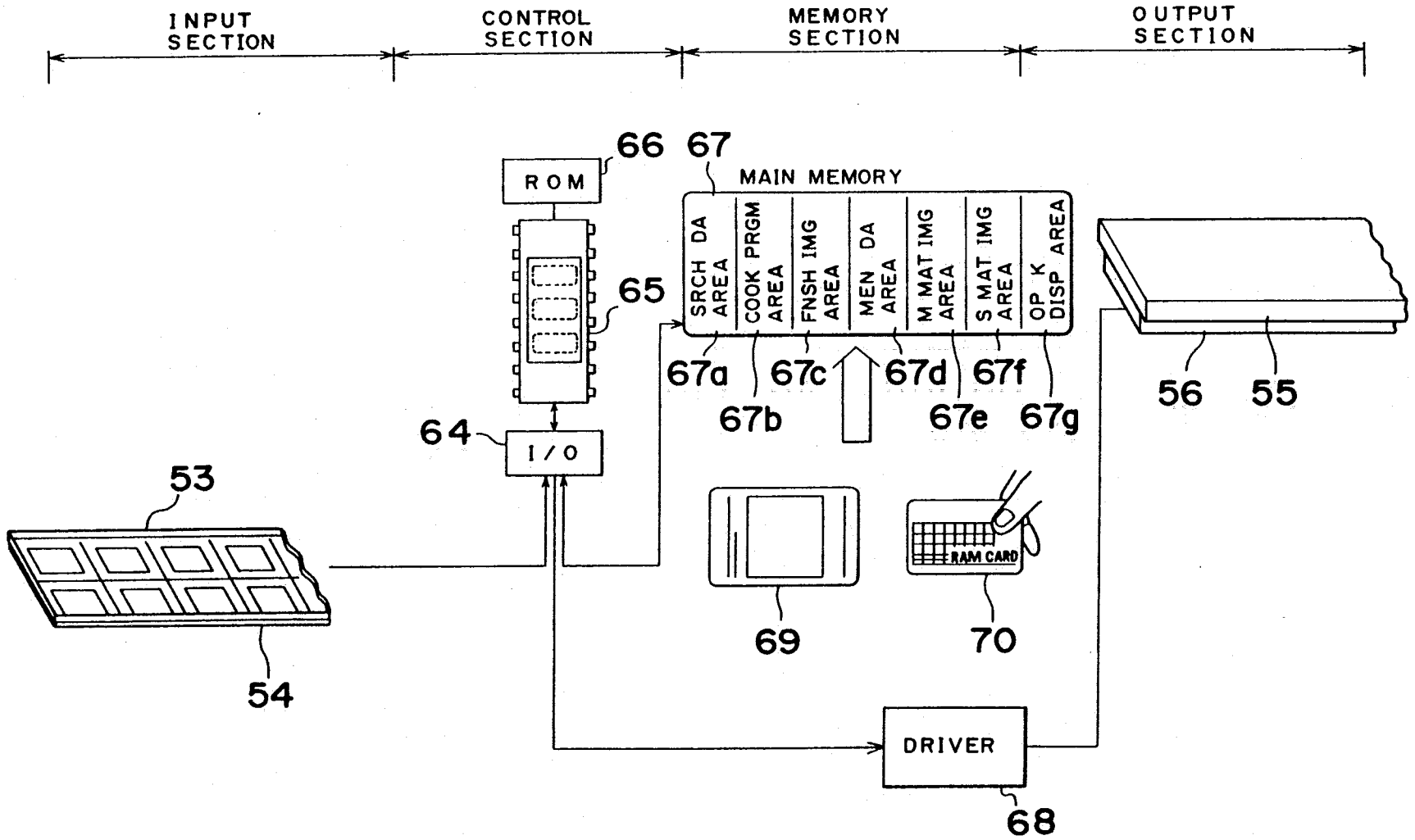
FIG. 4 is a block diagram of the control unit.
Figure 6A:
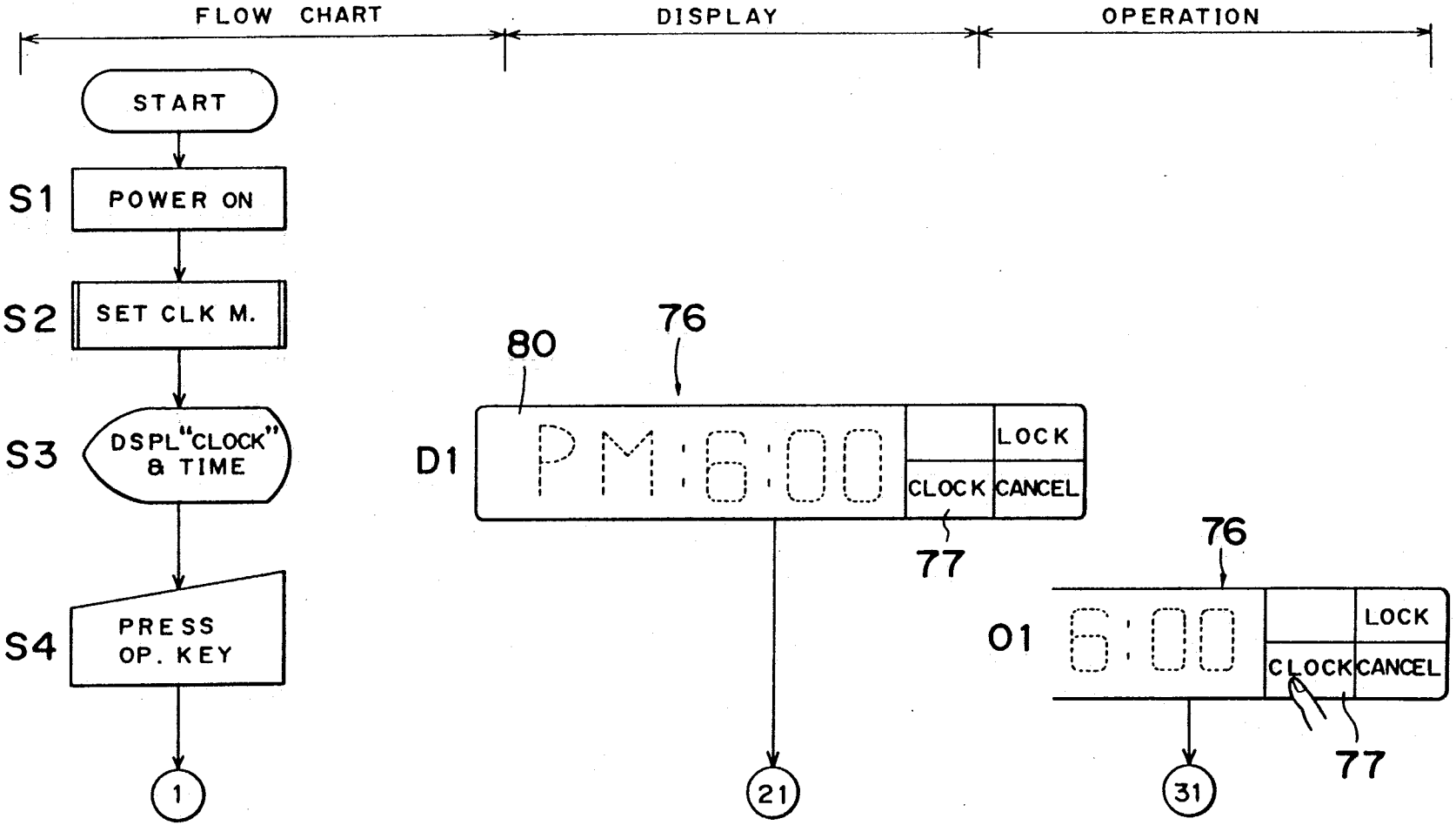
FIGS. 6(*a*),(*b*),(*c*),(*d*),(*e*),(*f*),(*g*) and (*h*) show a flow chart of the election procedure.
Figure 6B:
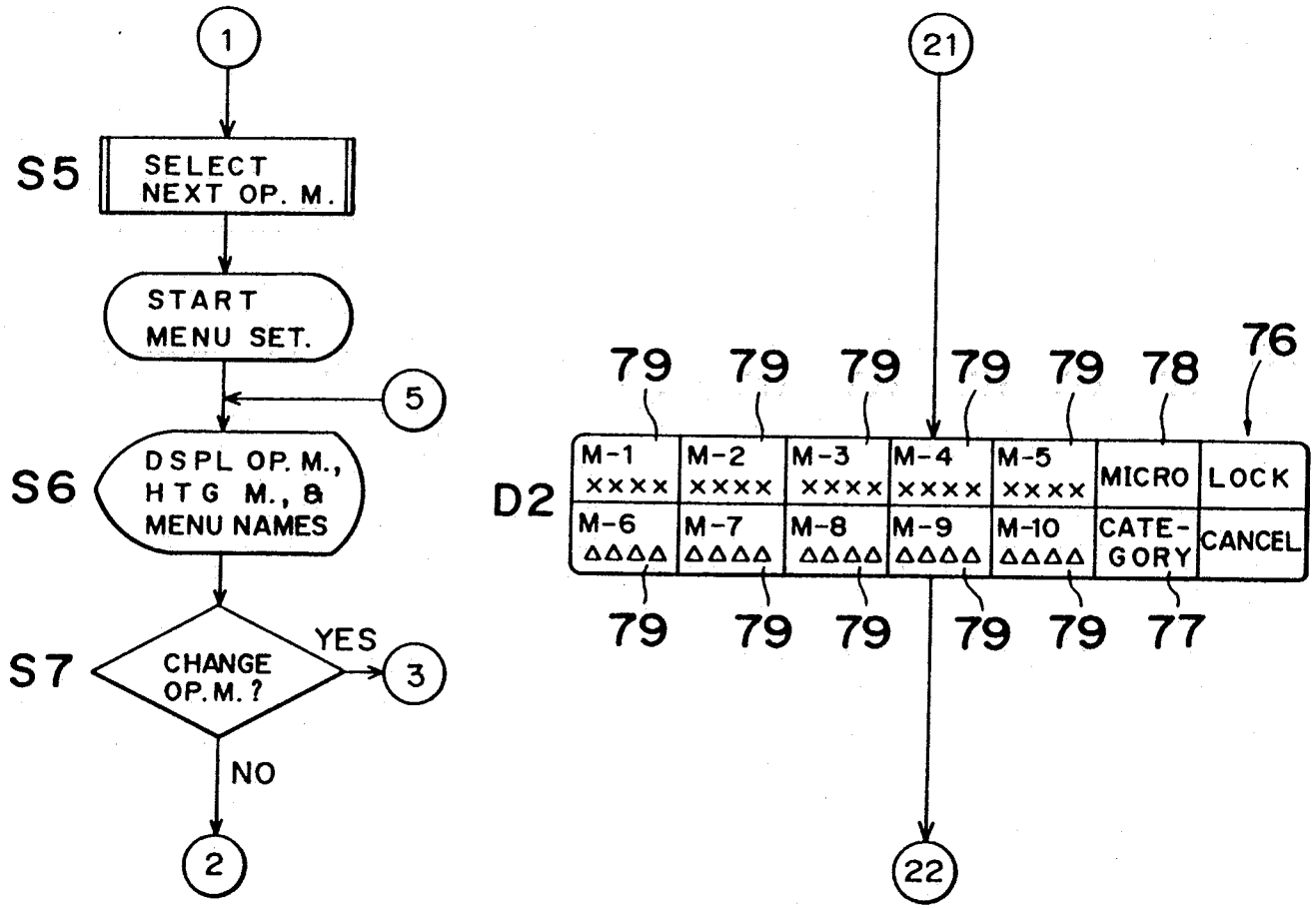
Figure 6C:
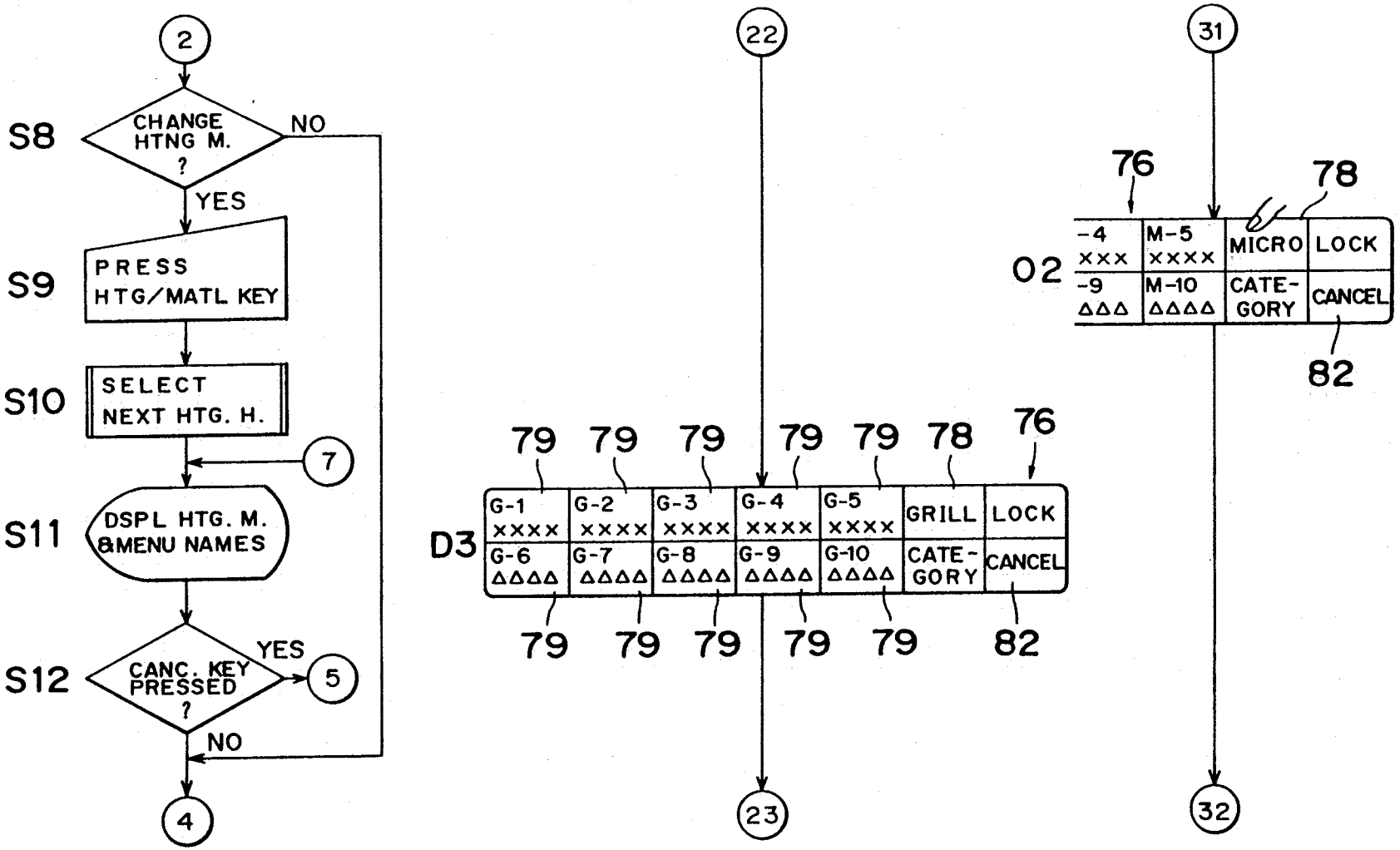
Figure 6D:
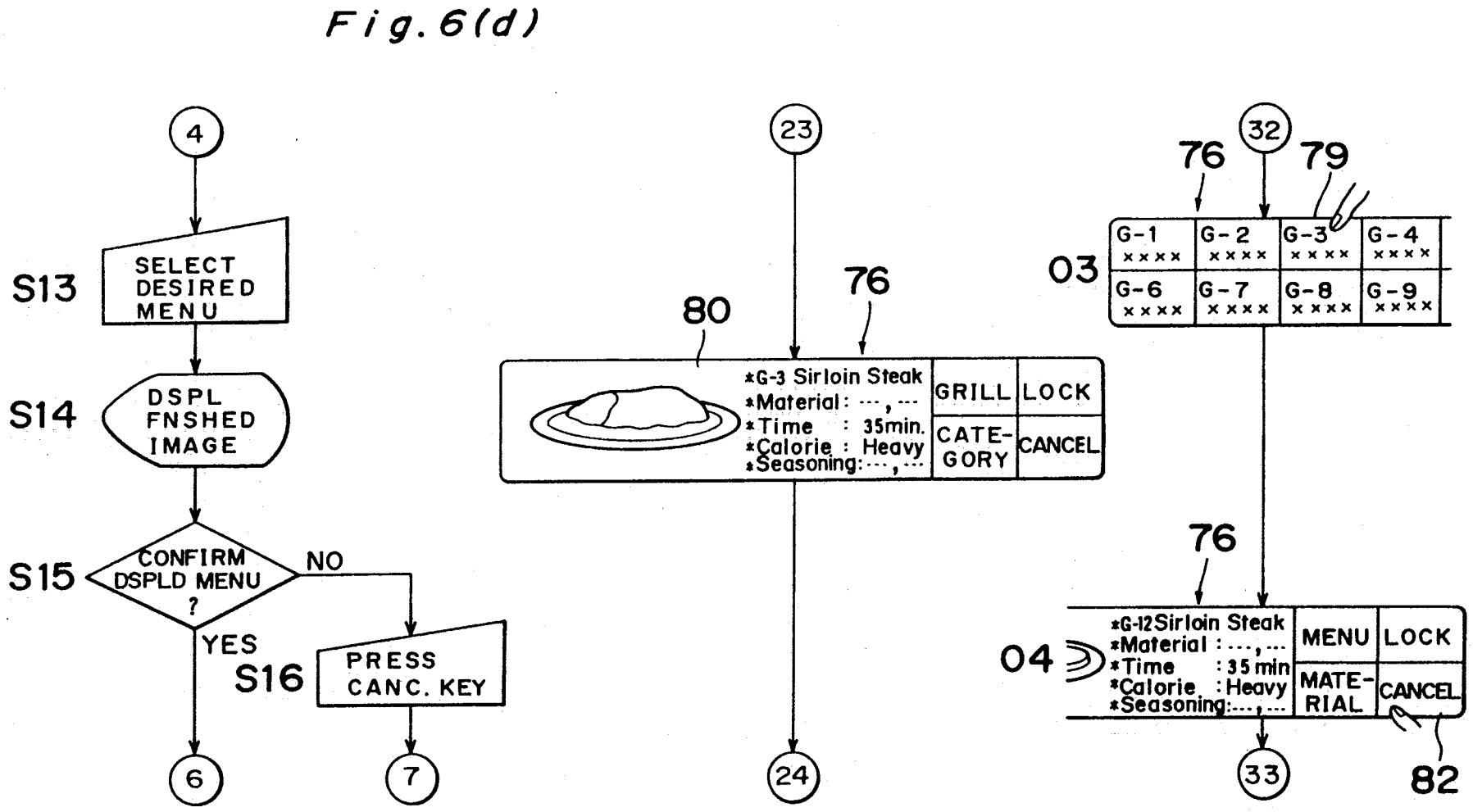
Figure 6E:
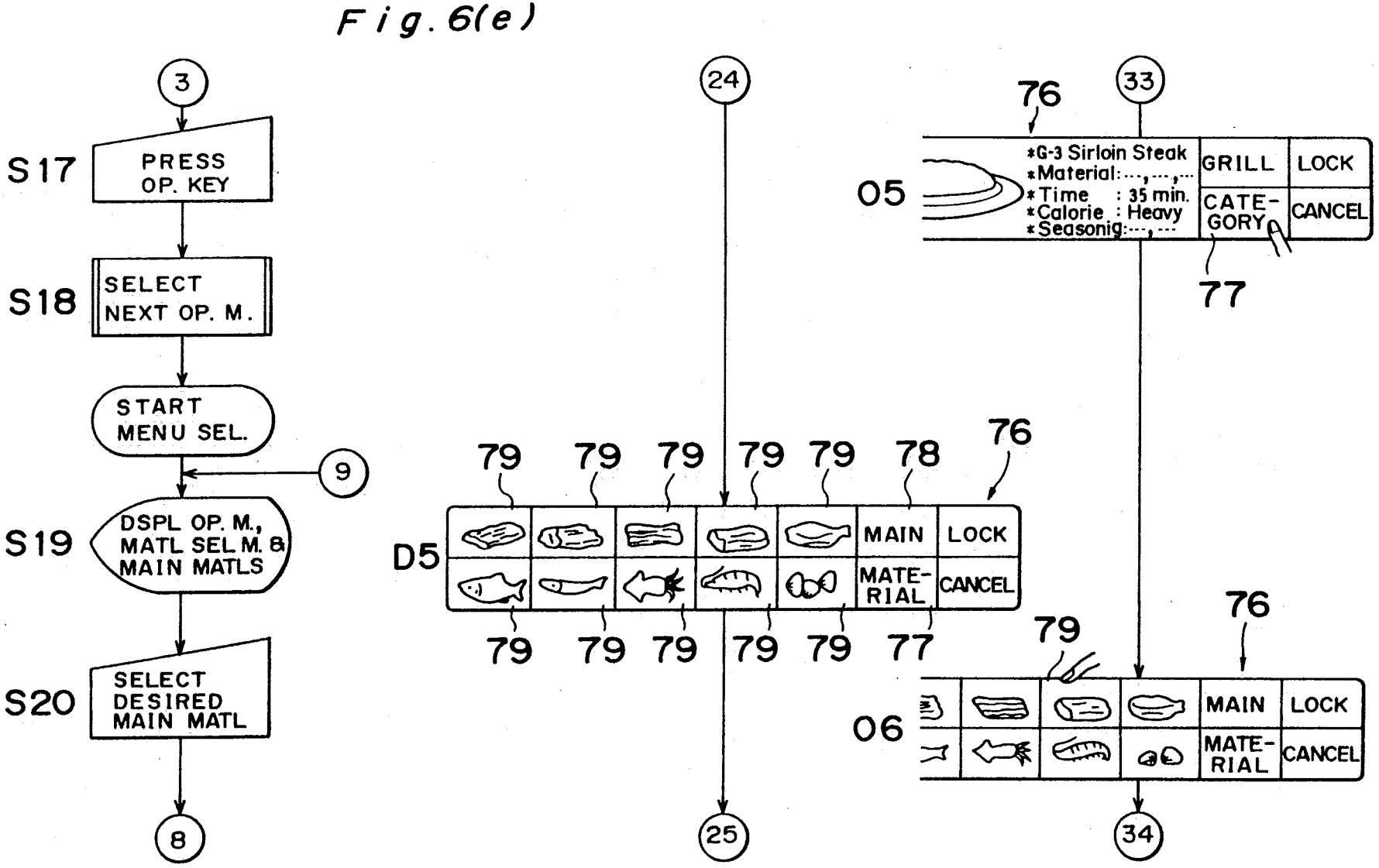
Figure 6F:
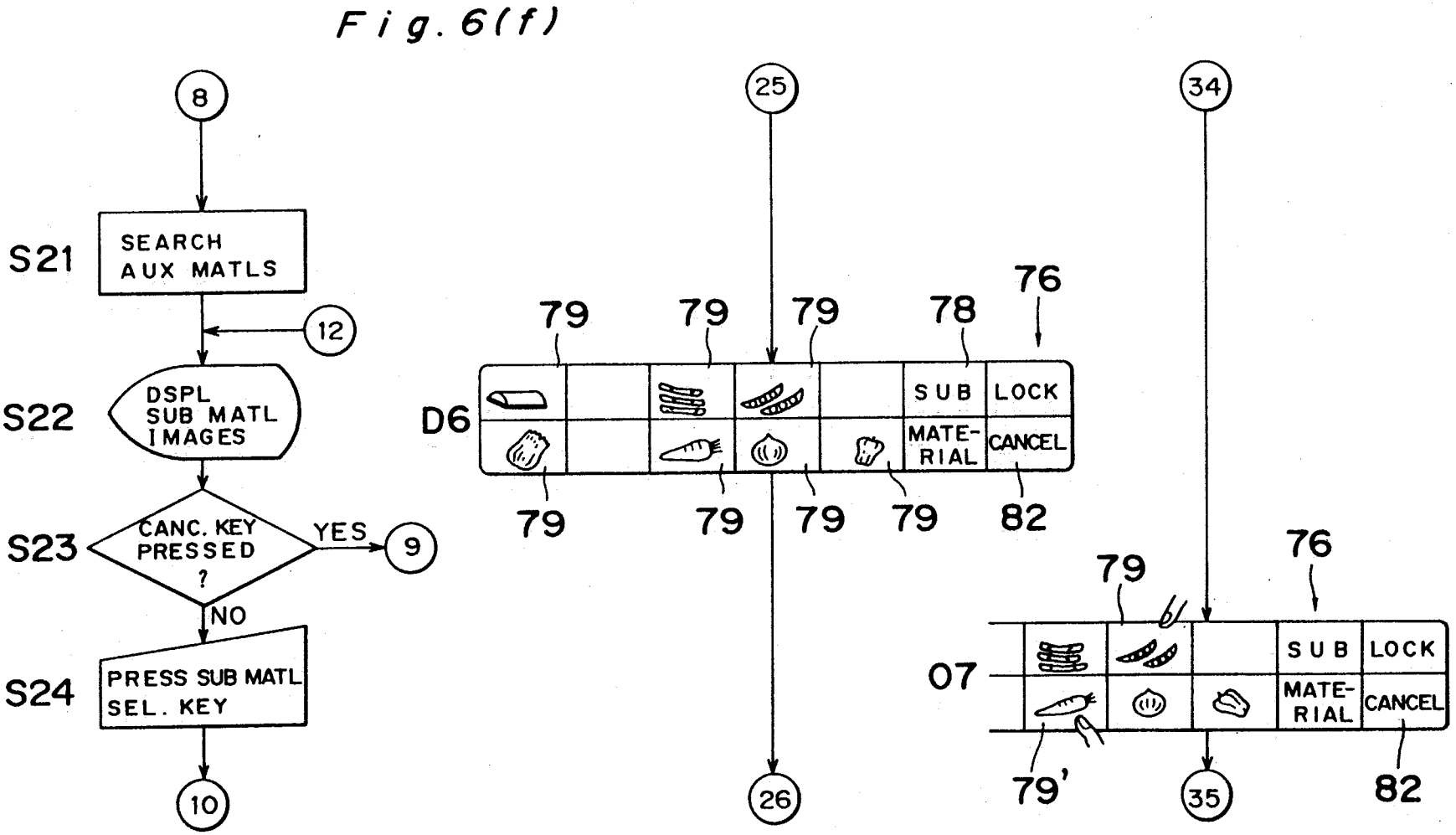
Figure 6G:
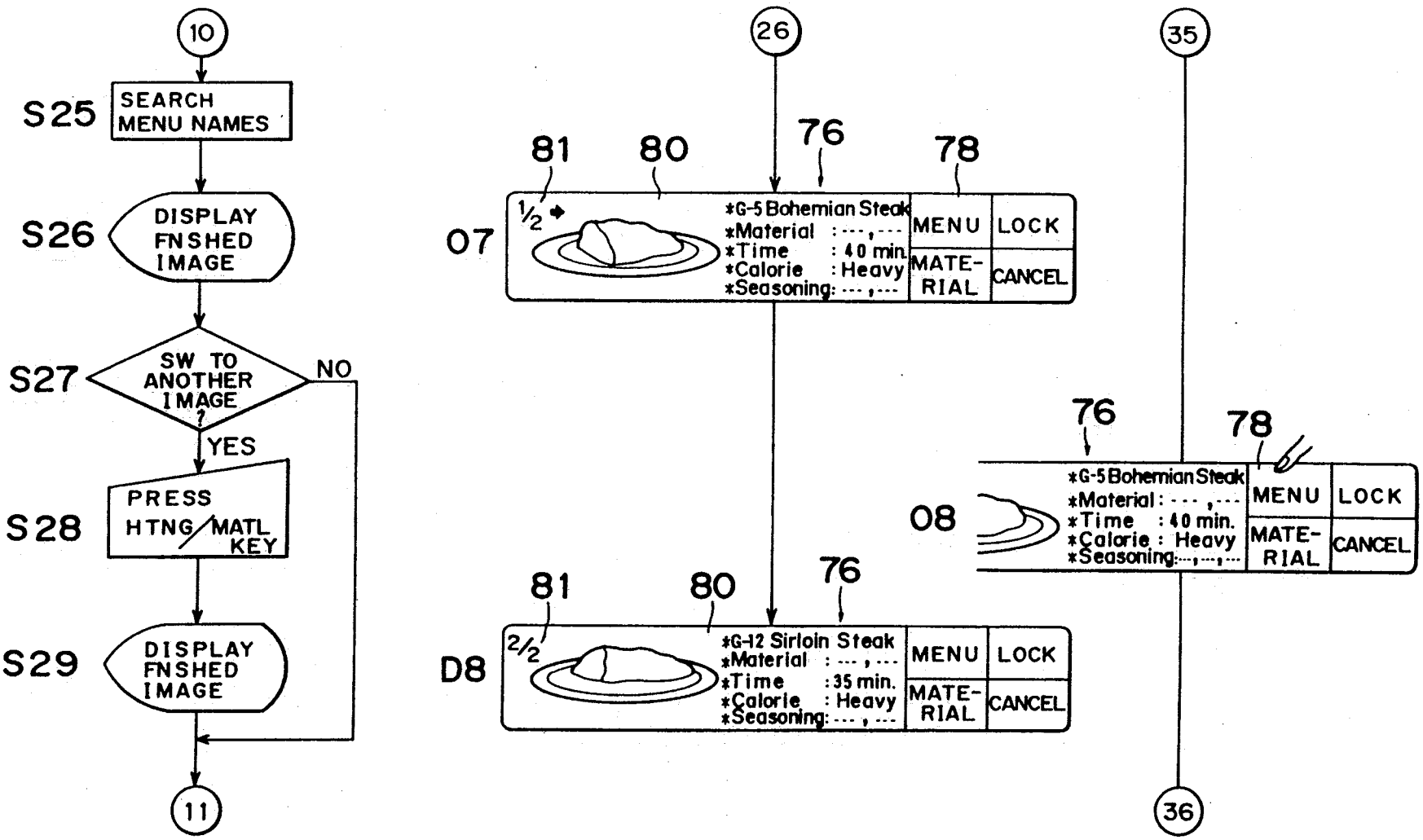
Figure 7:
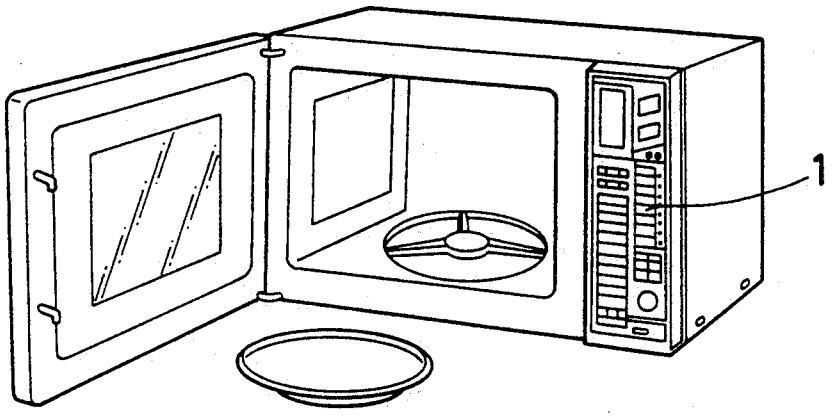
Fig. 7 PRIOR ART
FIG. 7 is an external view of a conventional microwave oven.
Figure 8:
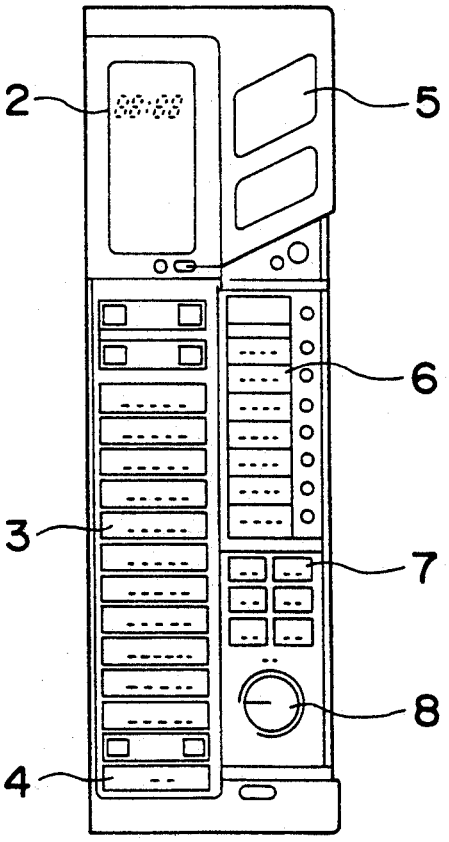
Fig. 8 PRIOR ART
FIG. 8 is an enlarged view of the operating panel of the control unit in FIG. 7.
Figure 9:
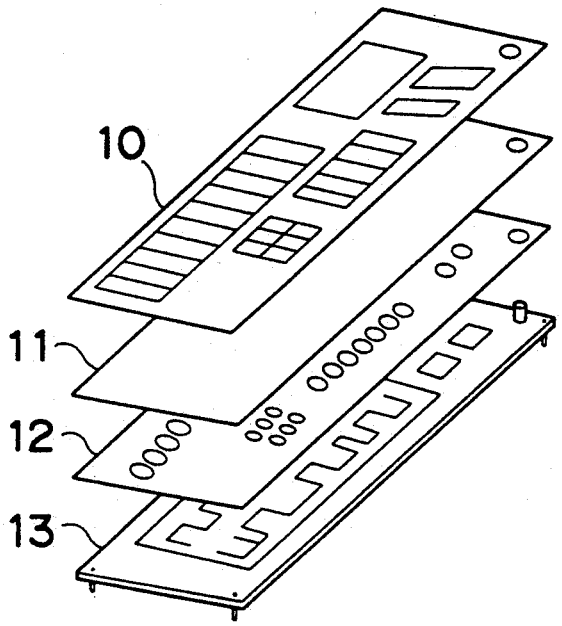
Fig. 9 PRIOR ART
FIG. 9 is an exploded view of the control unit in FIG. 8.
Figure 10:
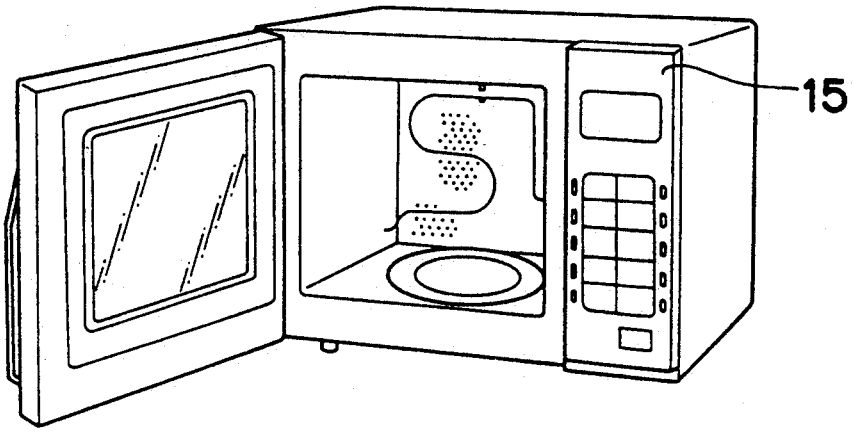
Fig. 10 PRIOR ART
FIG. 10 is an external view of a conventional microwave oven which differs from that shown in FIG. 7.
Figure 11:
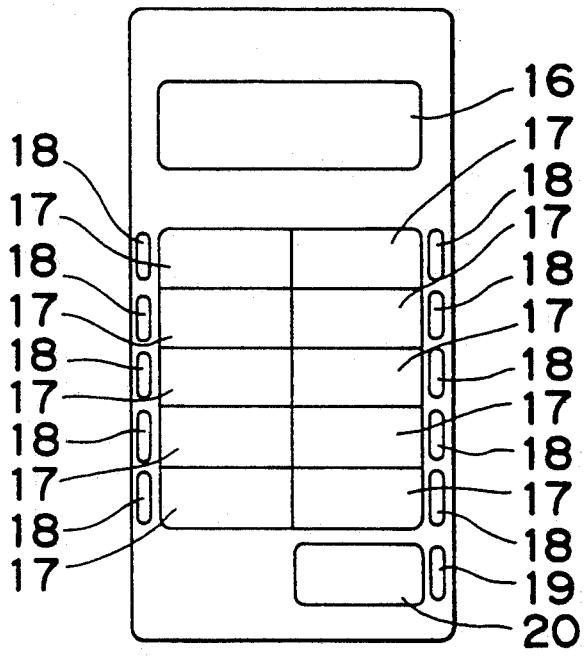
Fig. 11 PRIOR ART
FIG. 11 is an enlarged view of the display of the control unit in FIG. 10.
Figure 12:
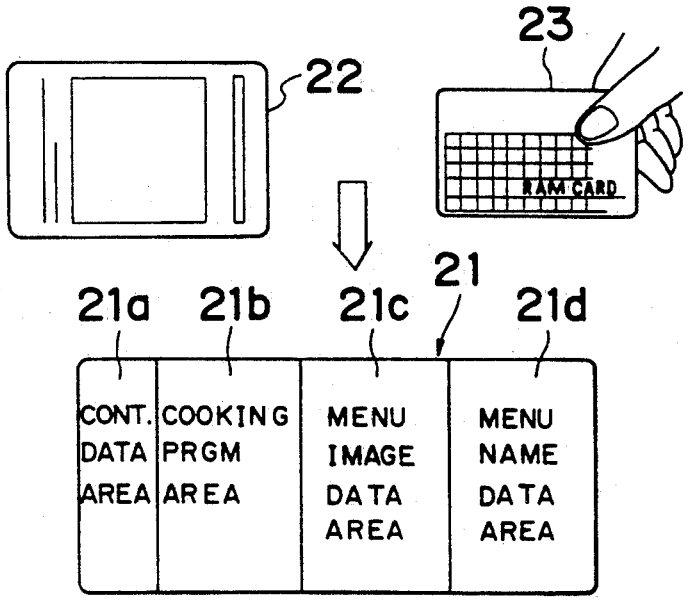
Fig. 12 PRIOR ART
FIG. 12 is a figure used to describe the loading of information from the external storage means for storage to the operation control memory of the control unit shown in FIG. 11.
Figure 13:
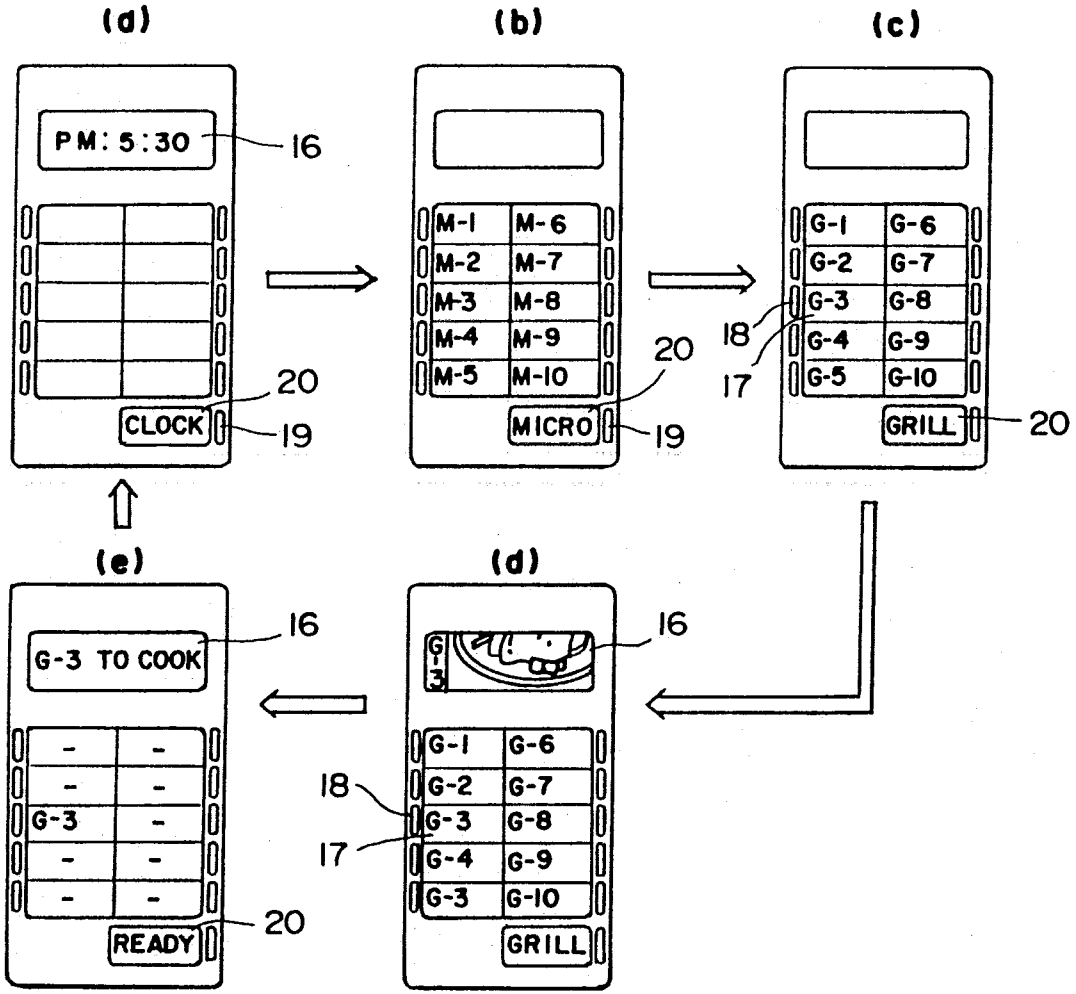
Fig. 13 PRIOR ART
FIG. 13 is a figure used to describe the menu selection procedure using the control unit in FIG. 11.
Figure 14:
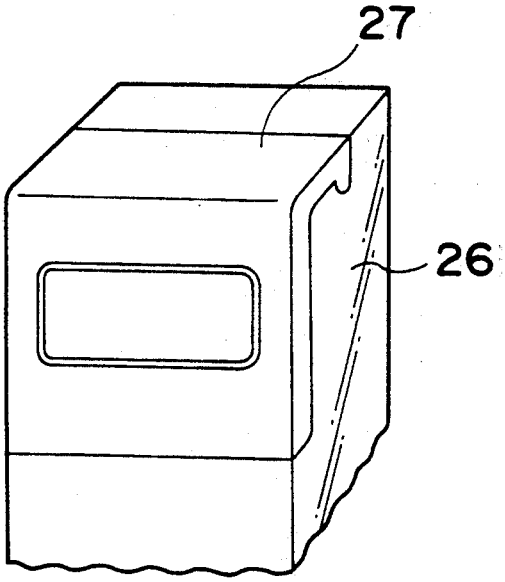
Fig. 14 PRIOR ART
FIG. 14 is a partial bird's-eye view of the control unit in a microwave oven which differs from those in FIG. 7 and FIG. 10.
Figure 15:
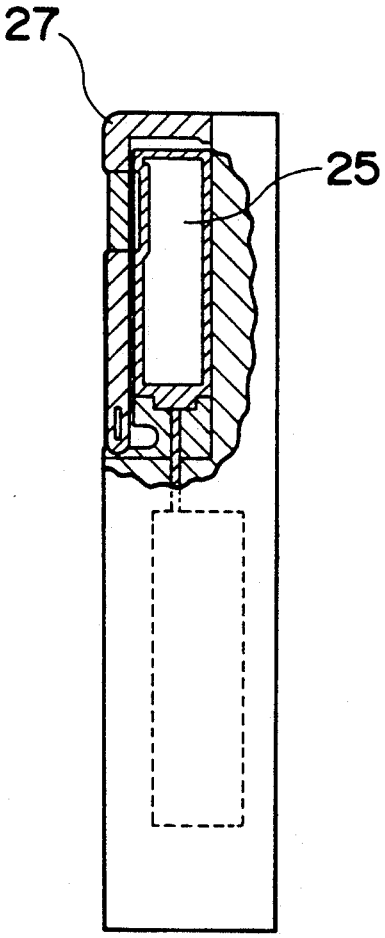
Fig. 15 PRIOR ART
FIG. 15 is a partial cross section of the control unit shown in FIG. 11.
Figure 16:
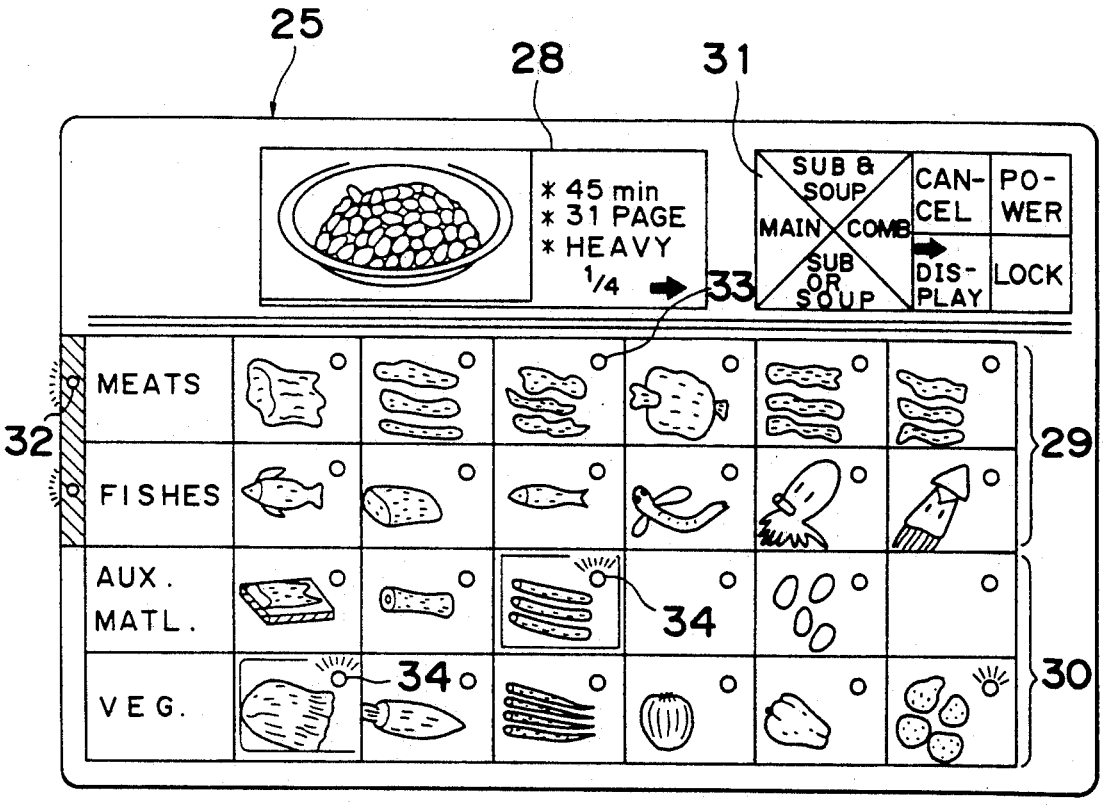
Fig. 16 PRIOR ART
FIG. 16 is an external view of the functional unit in FIG. 15.
Figure 17:
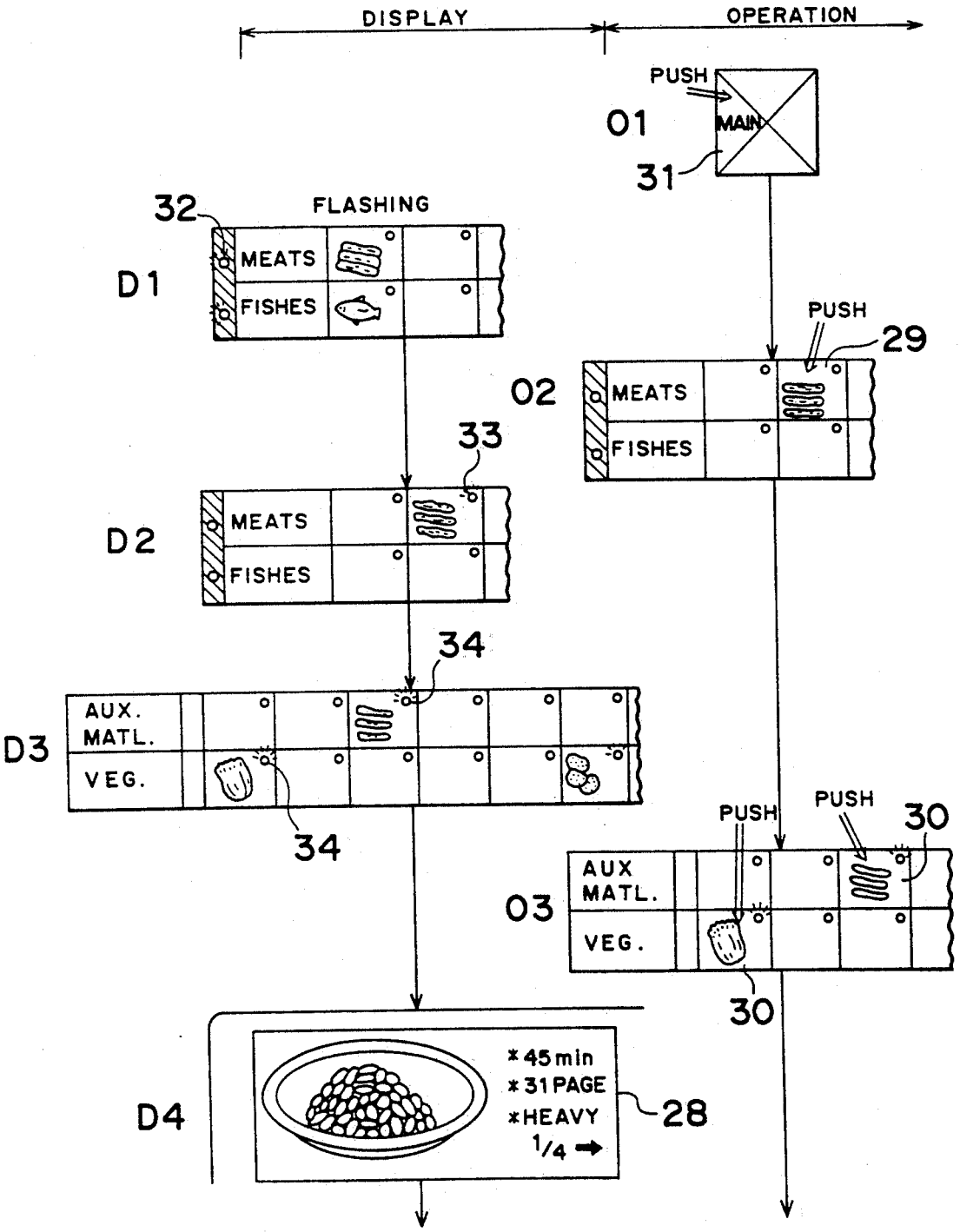
Fig. 17 PRIOR ART
FIG. 17 is a figure used to described the menu selection the functional unit shown in FIG. 16.

FIG. 4 is a block diagram of the control unit 51, which comprises, from the left side of the figure, an input section, a control section, a memory section, and an output section. The input section is formed by the transparent electrode switch sheet 54 and the overlay 53, the control section and memory section are formed by the control unit controller 58 shown in FIG. 3, and the output section is formed by the color LCD 55 and the display controller 56.

The main memory 67 of the control unit controller 58 forms the memory section and stores the cooking information, which includes the retrieval data, cooking programs, finished image data, menu name data, main material image data, auxiliary material image data, and operation key display data. This cooking information is stored and classified by, for example, cooking category (e.g., Chinese cuisine, Japanese cuisine) in an external storage device such as an IC card 69, a RAM pack 70 and so on.

The cooking information is described in detail below.

(a) retrieval data

This is data used to search for menu names based on the main and auxiliary material names, and includes main material name codes, two types of auxiliary material name codes, finished image codes, and menu name codes tagged thereto.

(b) Cooking Programs

The cooking programs include a heating program to control the microwave heating and grill heating, as well as a command program to provide instructions to the user, according to each menu selection.

(c) Finished Image Data

This information is used to display images of the finished menus on the display, and includes a finished image code and the corresponding finished image data tagged to each menu choice.

(d) Menu Name Data

This data is used when searching the menu names from the viewpoint of the heating modes (microwave heating mode and grill heating mode), and includes heating mode name codes categorized by heating mode and corresponding menu name codes.

(e) Main Material Image Data

Data to display images of the main materials in each menu choice.

(f) Auxiliary Material Image Data

Data to display images of the typical materials (auxiliary materials) other than the main material in each menu choice.

(g) Operation Key and Function Key Display Data

1. Data to display the operating mode name in the operation key to change the display contents of the color LCD 55.

The character codes used to express the operating mode names include CLOCK, CATEGORY, and MATERIAL.

2. Data to display the heating mode names in the CATEGORY operating mode.

Character codes for the heating mode names include MICRO and GRILL.

3. Data to display the material selection mode names in the MATERIAL operating mode.

Character codes for the material selection mode names include MAIN and SUB.

4. Data to display the screen selection mode names to change the menu finished image in the MATERIAL operating mode.

Character codes for the screen selection mode names include MENU.

5. Data to display the function mode names in the function keys used to cancel or confirm a selection according to the color LCD 55.

Character codes to display the function mode names include LOCK and CANCEL.

By, for example, inserting an IC card 69 holding this cooking information into the insertion slot 61 of the display controller 56 as shown in FIG. 3 (*c*), the cooking information is loaded into the appropriate main memory 67 locations: retrieval data area 67*a*, cooking program area 67*b*, finished image data area 67*c*, menu name data area 67*d*, main material image data area 67*e*, auxiliary material image data area 67*f*, and the operation key display data area 67*g*.

The CPU 65 (central processing unit) which constitutes the control section reads the required information from the cooking information stored in the main memory 67 as directed by the control program stored in the ROM (read-only memory) 66 through an input/output interface, and controls the input and output sections for menu selection processing. In other words, the CPU 65 forms the menu selection mode setting means, menu selection means, and the cooking information transfer means.

The menu names, finished menu image data, and main and auxiliary material image data stored in the main memory 67 are displayed in the color LCD 55 forming the output means.

Figure 5:
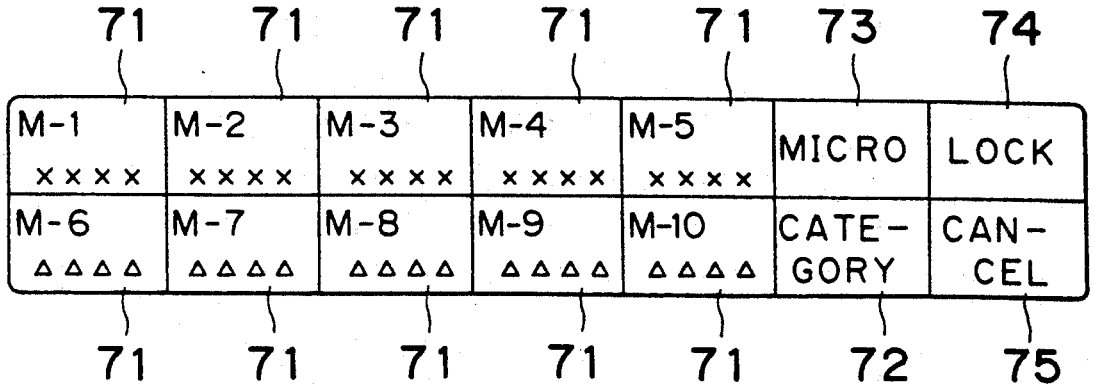
FIG. 5 shows one example of the color LCD (liquid crystal device) screen display in FIG. 3.

The display area of the color LCD 55 covers the entire side of the control unit 51, and can be divided into fourteen rectangular display regions as shown in FIG. 5. Of these fourteen display areas, the menu names, main material images, or auxiliary material images are shown in the ten mutually adjacent display areas 71 on the left side in the figure (in FIG. 5 the menu names are displayed). In display area 72 is displayed the operating mode name, and in display area 73 is displayed the heating mode name or material selection mode name or display change mode name according to the operating mode displayed in the display area 72 (in FIG. 5 the operating mode name is CATEGORY, and the heating mode name is MICRO). In display area 74 is displayed the function mode name LOCK, and in display area 75 is displayed the function mode name CANCEL.

In this example the menu names are categorized by heating mode, and change in the display according to the heating mode name displayed in the display area 73. Similarly, the main material images are assigned to correspond to the material selection mode "MAIN" and the auxiliary material images are assigned to correspond to the material selection mode "SUB" with the display contents changing according to the material selection mode name displayed in the display area 73.

The ten display areas 71 in the display area of the color LCD 55 are formed so that the ten display areas 71 can be combined into a single finished image display area. As will be described in detail below, when a menu selection is made, the finished image of the menu selection is displayed on the finished image display area. Thus, when the finished image of the menu selection is displayed on the control unit 51, the displayed image occupies 5/7 of the available display area on the control unit 51 (specifically, 5/7 of the complete width of the microwave oven body 50), and is therefore large enough to make the displayed menu selection appear appetizing to the user.

The character information or image information displayed on the color LCD 55 is read by the CPU 65 as required from the retrieval data area 67*a*, finished image data area 67*c*, menu name data area 67*d*, main material image data area 67*e*, auxiliary material image data area 67*f*, and operation key display data area 67*g* in the main memory 67. Then, the read character information or image information is sent through the input/output interface 64 to the display controller 56, which then controls the color LCD 55 as shown in FIG. 5 to display the image. In other words, the CPU 65 and the display controller 56 combined form the operation key display means.

The transparent electrode switch sheet 54, which forms the input section, is a transparent sheet provided with fourteen transparent electrode switches and covering the color LCD 55 so that the transparent electrode switches are positioned to correspond to the fourteen display positions of the color LCD 55. Thus, the transparent electrode switch sheet 54 overlays the top of the color LCD 55 as shown in FIG. 3. As a result, the character information or image information displayed in the corresponding display areas of the color LCD 55 can be seen through the transparent electrode switches in the transparent electrode switch sheet 54.

The user is therefore able to refer to the character information or image information seen through the transparent electrode switch sheet 54, and by touching the location of the characters or image, a selection/-command signal is output from the corresponding transparent electrode switch in the transparent electrode switch sheet 54. In other words, the color LCD 55 and the transparent electrode switch sheet 54 function integrally to form an operating panel with operation keys. Hereinafter the color LCD 55 and the transparent electrode switch sheet 54 are collectively referred to as the operating panel and the display areas and corresponding transparent electrode switches are collectively referred to as the keys.

Of the fourteen keys on the operating panel, the keys corresponding to the ten display areas 71 of the color LCD 55 in which are displayed the menu names or material images are referred to as the selection keys. Similarly, the key for the display area 72 in which is displayed the operating mode name is referred to as the operation key, the key for the display area 73 in which is displayed the heating mode name or the material selection mode name or the display selection mode name is referred to as the heat/material key, the key for the display area 75 showing the function mode name "LOCK" is referred to as the lock key, the key for the display area 75 showing the function mode name "CANCEL" is the cancel key, and the lock and cancel keys together are referred to as the function keys.

In the preferred embodiment, when a selection key on the operating panel is pressed, the menu or material displayed in the corresponding display area 71 of the color LCD 55 is selected. Furthermore, when the operation key or the heat/material key is pressed, the operating mode names and the heat or material selection modes names to be displayed in the display areas 72 and 73 in the color LCD 55 will be sequentially and endlessly selected based on CPU 65 control. The display contents of the selection keys as defined above change in response to the selection of the heating mode or material selection mode. The selection and display sequence of the operating mode, heating mode, and material selection mode is previously determined according to the control program stored in the ROM 66. Moreover, when the heat/material key display is changed to the screen change mode name MENU as a result of materials selection input through the selection keys and the heat/material key is pressed, the finished images to be displayed in the finished image display area of the color LCD 55 will be sequentially changed.

Furthermore, when the LOCK function key is pressed, the menu selection for which the finished image is displayed in the finished image display area is confirmed. On the other hand, the menu selection can be cancelled by pressing the CANCEL function key.

Thus, the selection/specification signals output from the transparent electrode switches of the transparent electrode switch sheet 54 are first input to the display controller 56. The signal is associated with the signal expressing the display contents of the display area in the color LCD 55 at the position corresponding to the position of the transparent electrode switch, and is read into the CPU 65 through the input/output interface 64. Consequently, the CPU 65 knows by means of the selection/command signal from the transparent electrode switch of the transparent electrode switch sheet 54 which of menu names, material specifications, operating modes, heating modes, material selection modes, or function modes are selected/specified.

Each of the above modes is described next. The above operating mode may include, for example, the following modes.

(I) CLOCK mode

A mode to display the current time set by means of a rotary encoder, for example, to the finished image display area formed by the ten display areas 71 in the color LCD 55. (The rotary encoder not shown in the figures concerned)

(II) CATEGORY mode

A mode for selecting a menu from a menu name listing, wherein the menu names are categorized by heating mode in the display areas 71 of the color LCD 55.

(III) MATERIAL mode

A mode for selecting a menu by specifying the materials used in the menu selection, wherein the material image list to be displayed in the display areas 71 of the color LCD 55 is categorized by material selection mode as will be described below.

Namely, this is one of versions of menu selection modes as referred in CATEGORY mode.

The heating modes include, for example, the following modes.

(A) MICRO mode

A microwave heating mode to cook materials by heat generated by microwave radiation emitted from the magnetron.

(B) GRILL mode

A grill heating mode which cooks materials by heat generated by an electric heater.

The material selection mode includes, for example, the following modes.

(a) MAIN mode

A mode where the material list to be listed in the display areas 71 of the color LCD 55 is limited to main materials when in the MATERIAL mode.

At this time, the displayed main material images are the images for the main materials used in all menu choices associated with the cooking category (i.e., the cooking category in association with the IC card in use) related to the main material image data loaded into the main material image data area 67*e* of the main memory 67. Thus, even if the user wants to change the cooking category beyond the limit of main material specifications, the main material images displayed in the color LCD 55 can be changed to the main material images associated with the cooking category by simply changing the IC card 69 loaded in the display controller 56. Therefore, even if the cooking category is changed to one in which the main materials used differ greatly, the main material images corresponding to that cooking category can be displayed without exception. In other words, the selection keys can be assigned to various different main materials.

(b) SUB mode

This is a mode where the material list to be listed in the display areas 71 of the color LCD 55 is limited to auxiliary materials.

The auxiliary material images displayed at this time are the images for the auxiliary materials used in all menus associated with the corresponding cooking category.

The screen change mode is a mode for changing the contents of the finished images of each menu displayed in the finished image display area of the color LCD 55.

A microwave oven having the above-described construction will operate in the following manner in the menu selection process.

FIGS. 6(*a*),(*b*),(*c*),(*d*),(*e*),(*f*),(*g*) and (*h*) show a flow chart of the menu selection process executed according to CPU 65 control. In FIGS. 6(*a*),(*b*),(*c*),(*d*),(*e*),(*f*),(*f*) and (*h*), the menu selection procedure flow chart followed by the user and the CPU 65 is shown on the left side of the figures, on the right is shown the operating procedure to be followed by the user, and in the center are shown the changes in the display of the operating panel 76 as the flow chart is followed in response to the display results on the color LCD 55 seen through the transparent electrode switch sheet 54. In the following description, the flow chart procedure is referred to in steps, the operating procedure in operating steps, and the display contents in display steps.

It is assumed that an IC card 69 for a specific cooking mode has been selected by the user and inserted into the insertion slot 61 of the display controller 56, and the cooking information associated with the specific cooking category registered in the IC card 69 is loaded into the main memory 67.

At step S1, the microwave oven is plugged in and enters a power on state.

At step S2, the operating mode is automatically set to CLOCK.

At step S3, the display of the operation key 77 in the operating panel 76 is automatically set to CLOCK as shown in display step D1, and the current time appears in the finished image display area 80.

At step S4, the operation key 77 in the operating panel 76 is pressed as shown in operation step 01.

At step S5, the operating mode CATEGORY to come next to the currently selected operating mode CLOCK is automatically selected. Then, the first heating mode, MICRO, in the newly selected operating mode CATEGORY is automatically selected. Moreover, the menu names assigned to the heating mode MICRO are retrieved from the menu name data area 67*d* in the main memory 67. When this is completed, menu selection based on the menu name listing selection mode starts.

At step S6, the display of the operation key 77 in the operating panel 76 changes to CATEGORY as shown in display step D2, the heat/material key 78 display changes to MICRO, and the menu names found in the retrieval of the step S5 are displayed in the selection keys 79.

At step S7, the user decides whether to change the operating mode (specifically, whether to change to menu selection using the material specification selection method). If the menu is not decided or for any other reason the user wishes to select a menu through material specification selection, the procedure advances to step S17. If there is no change in the menu selection mode, however, the procedure advances to step S8, and menu selection based on the menu name listing selection method continues.

At step S8, the user decides whether to change the heating mode. Based on this decision, the procedure advances to step S9 if it is decided to change the heating mode because the desired menu is not among the menu names associated with the currently selected heating mode, and advances to step S13 if the heating mode is not changed.

At step S9, the heat/material key 78 in the operating panel 76 is pressed once as shown in operation step O2.

At step S10, the heating mode (GRILL is after MICRO in FIG. 6 (*b*)) to come next to the currently selected heating mode (MICRO in FIG. 6 (*b*)) is automatically selected. Then, the menu names associated with the selected heating mode (GRILL in FIG. 6 (*c*)) are retrieved from the menu name data area 67*d* in the main memory 67.

At step S11, as shown in display step D3, the display of the heat/material key 78 in the operating panel 76 changes to the heating mode selected in step S10 (GRILL in FIG. 6 (*c*)), and the displays for the selection keys 79 are changed to the menu names searched in step S10.

At step S12, it is determined whether the CANCEL key 82 on the operating panel 76 was pressed. If it was, the procedure returns to step S6, the heating mode is reset to MICRO, and the menu names corresponding to the MICRO heating mode are again displayed. If the CANCEL key 82 was not pressed, however, (i.e., if the GRILL mode is acceptable), the procedure advances to step S13.

At step S13, the selection key 79 at which the desired menu name ("G-3 XXXX" in FIG. 6 (d)) is displayed in the operating panel 76 is pressed as shown in operation step O3, and the menu choice is selected/specified.

At step S14, based on the menu name selected/specified in step S13, the corresponding finished image code is retrieved from the retrieval data area 67*a* in the main memory 67. The finished image data corresponding to the searched finished image code is then retrieved from the finished image data area 67*c*.

Then, the finished image of the menu selection is displayed in the finished image display area 80 of the operating panel 76 as shown in display step D4 based on the retrieved finished image data.

At step S15, the user, referring to the finished image displayed in the finished image display area 80 of the operating panel 76, determines whether to confirm the displayed menu selection. If the selection is confirmed, the procedure advances to step S32, and if the selection is cancelled, the procedure advances to step S16.

At step S16, the CANCEL key 82 is pressed as shown in operation step 04.

Thus, the menu selection made in step S13 ("G-3 Sirloin steak" in FIG. 6 (*d*)) is cancelled, the procedure returns to step S11, and the menu names corresponding to the heating mode GRILL are again displayed.

At step S17, as shown in operation step 05, the operation key 77 on the operating panel 76 is pressed once.

At step S18, the operating mode automatically changes from the currently selected mode (CATEGORY) to the next operating mode (MATERIAL) and the first material selection mode, "MAIN" in the MATERIAL operating mode is automatically selected. In addition, the main material image data is retrieved from the main material image data area 67*e* in the main memory 67.

Now menu selection based on the material selection method is available.

At step S19, as shown in display step D5, the display of the operation key 77 in the operating panel 76 changes to MATERIAL, the display of the heat/-material key 78 changes to MAIN, and the displays of the selection keys 79 change to the main material images based on the main material image data read at step S18.

At step S20, as shown in operation step 06, the selection key 79 at which the desired main material image (an image of a beef block in FIG. 6 (*e*)) is displayed in the operating panel 76 is pressed, accordingly the desired main material is selected/specified.

At step S21, the material selection mode SUB is automatically selected, and the names of all menus for which the main material is the main material selected/specified in step S20 are retrieved from the search data area 67*a* in the main memory 67, and all auxiliary materials associated with the found menu names are retrieved. After that, the auxiliary materials image data is read from the auxiliary material image data area 67*f* of the main memory 67 based on the retrieved auxiliary materials names.

At step S22, as shown in display step D6, the display for the heat/material key 78 in the operating panel 76 is changed to SUB, and the displays for the selection keys 79 are changed to the auxiliary materials images based on the auxiliary materials image data read in step S21.

At step S23, it is determined whether the CANCEL key 82 on the operating panel 76 should be pressed or not by the user. If the result of consideration was yes, the procedure returns to step S19, where the material selection mode MAIN is selected again and the main material images corresponding to the MAIN material selection mode are displayed again. If the CANCEL key 82 was not pressed (i.e., if the SUB material selection mode is acceptable), the procedure advances to step S24.

At step S24, the selection keys 79,79' in which the two types of auxiliary materials desired, "kidney beans" and "carrots" in FIG. 6 (*f*), are displayed in the operating panel 76 are pressed as shown in operation step O7, accordingly the two desired auxiliary materials are selected/specified.

When the user is not quite sure about all the necessary materials (two kinds of subsidiary materials), the user may press the selection key in which the one desired material is displayed in the operating panel 76 and presses one selection key in which no auxiliary material is displayed. Specifically, selection of the auxiliary materials is completed when it is detected that two of the selection keys 79 have been pressed.

At step S25, the names of all menus associated with the main and auxiliary materials selected in steps S20 and S24, respectively, are retrieved from the retrieval data area 67*a* of the main memory 67.

At step S26, the finished image codes are retrieved from the retrieval data area 67*a* in the main memory 67 based on the menu names found in step S25, and the finished image data for the retrieved finished image codes is retrieved from the finished image data area 67*c*. Then based on the retrieved finished image data, the finished image of each current menu choice ("G-5, Bohemian steak" in FIG. 6 (*g*)) is displayed in the finished image display area 80 of the operating panel 76 as shown in display step D7. In addition, the heat/material key 78 display changes to MENU, indicating that the screen changing mode where change of the finished image to be displayed is available based on retrieved image data through a press of the key is selected.

Note that a symbol 81 is displayed in the top left corner of the finished image display area 80 as shown in display step D7 to show that plural menu names were found in the retrieval conducted in step S25. The symbol 81 shown in display step D7 reads "½→". The "½" in the symbol 81 shows that, of the total "2" finished images found, the number "1" image is currently displayed, and the "→" arrow indicates that the display on the screen can be changed to the finished image of the next menu name.

At step S27, the user refers to the finished image of the current menu selection displayed on the finished image display area 80 of the operating panel 76 and the symbol 81, and decides whether to switch the finished image to that of the other menu. If it is decided to switch, the procedure advances to step S28, and if not the procedure advances to step S30.

At step S28, the heat/material key 78 displaying MENU is pressed as shown in operation step 08.

At step S29, the next finished image data to be displayed is retrieved based on the menu name to come next to that of the finished image now on display out of all the rest of menu names found in step S25. Based on the retrieved finished image data, the finished image for the next menu selection ("G-12 Sirloin steak" in FIG. 6 (*g*)) is displayed in the finished image display area 80 of the operating panel 76 as shown in display step D8.

At this time the "→" arrow in the symbol 81 is erased and the "½" changes to "2/2" to indicate that the currently displayed finished image is the last image retrieved according to the current materials selection/specification.

At step S30, the user refers to the finished image displayed in the finished image display area 80 of the operating panel 76, and decides whether to confirm the displayed menu choice. If the displayed menu is confirmed, the procedure advances to step S32, and if the menu selection is not confirmed, the procedure advances to step S31.

At step S31 the CANCEL key 82 is pressed as shown in operation step O9.

Thus, the menu selection for which the finished image was displayed in step S29 is cancelled ("G-12 Sirloin steak" in FIG. 6 (*g*)), and the procedure returns to step S22, where the auxiliary materials images assigned to the material selection mode SUB are displayed again.

At step S32, as shown in operation step 010, the lock key 83 in the operation panel 76 is pressed.

At step S33, the cooking program associated with the menu name for which the finished image was displayed in step S14 or step S29 is retrieved from the cooking program area 67*b* in the main memory 67. The found cooking program is then loaded into the cooking control memory (not shown in the figure) in the control unit controller 58 shown in FIG. 3, and the desired menu selection is confirmed.

Thus, heat cooking for the confirmed menu selection is executed as controlled by the cooking controller (not shown in the figures) according to the cooking program stored in the cooking control memory.

As is clear from the above-described embodiment, the operating panel 76 used during menu selection in the present invention is formed by laminating a color LCD 55 having fourteen rectangular display areas with a transparent electrode switch sheet 54 having fourteen transparent electrode switches at positions corresponding to the display areas of the color LCD 55, i.e., each key of the operating panel 76 is formed from a transparent electrode switch and a display area. Then, by operating the operation key 77 and the heat/material key 78 on the operating panel 76, menu names or main material images or auxiliary material images are displayed in turn in the ten selection keys 79 for selecting/specifying the menus and materials.

Thus, when menu names are displayed in the selection keys 79, a menu selection can be made using a menu name listing selection mode by operating the selection keys, and when the displays of selection keys 79 are changed to show the main material images or the auxiliary material images, a menu selection can be made using a material specification selection mode. Therefore, when the menu to be prepared is undecided or when the user is unfamiliar with the available menu selections or when the user is not quite sure about all the necessary materials (two kinds of secondary materials), the menu can be easily selected by a simple material specification selection mode. Furthermore, when the user wishes to select a known menu, that menu can be quickly selected with a simple menu selection mode setting means.

Furthermore, the image data for the main and auxiliary material images displayed in the selection keys 79 of the operating panel 76 is stored in the IC card 69 (or RAM pack 70 or other external data storage means) classified by cooking category. By loading the IC card 69 (or RAM pack 70) associated with the desired cooking category into the display controller 56, the main and auxiliary material image data associated with that cooking category is loaded into the main memory 67 of the control unit controller 58.

Thus, by simply changing the IC card 69 (or RAM pack 70), the displays of the selection keys 79 are changed to the main material images or the auxiliary material images associated with the cooking category stored in the replaced IC card 69 (or RAM pack 70), and the selection keys 79 can therefore be assigned to multiple materials. As a result, even if there is a great change in the main materials to be used in the available material selections associated with the selected cooking category, all main materials associated with that new cooking category can be selected.

Furthermore, depending upon whether the menu name listing selection mode or the material specification selection mode is currently used, the menu names used to select/specify the menu or the main or auxiliary material images are displayed in each of the ten mutually adjacent selection keys 79 on the operating panel 76 (i.e., the mutually adjacent display areas 71 in the color LCD 55). Still furthermore, when one of the selection keys 79 is pressed to select/specify a specific menu, the ten mutually adjacent selection keys 79 collectively compose a single finished image display area 80, and a finished image of the selected/specified menu is displayed in the finished image display area 80.

Therefore, the screen area displaying the image of the finished menu is large enough to help stimulate the appetite of the user for the displayed selection.

Moreover, because the operating panel 76 is formed by the color LCD 55 and the transparent electrode switch sheet 54 as described above, the displays of the keys are changed as required according to the corresponding keys. Thus, in all operations, the user only needs to press keys on which there is a displayed content. Therefore, the user can easily make a menu selection by repeating a simply key operation according to the display contents of the keys.

Furthermore, the character information and image information to be used in the above displays is registered in the external storage means according to cooking category. Therefore, by expanding the range of cooking categories registered in the external data storage means, a same microwave oven comprising this control unit 51 can be used for either domestic or export market sale. In addition, by simply changing the contents of the cooking information stored in the external storage means, a complete line-up of mid-range to high price microwave ovens can be provided.

The finished image display area 80 in the operating panel 76 of the control unit 51 in the above embodiment of the invention forms ten continuous display areas in the color LCD 55. However, the present invention shall not be so limited, and the number of display areas composing the finished image display screen can be changed as desired according to the size and number of display areas, and the size of the control unit 51.

The heating modes in the preferred embodiment described above are set to two modes: a microwave heating mode and a grill heating mode. However, the present invention shall not be so limited, and other heating modes may be added, including a compound heating mode where microwave heating and grill heating are executed alternately under duty cycle control, and a simultaneous heating mode achieved by simultaneously controlling the output of the magnetron and the output of the electric heater at a specific rate.

In the preferred embodiment described above, the number of menus which can be selected in the material specification selection mode is set at two, but the present invention shall not be so limited.

In the preferred embodiment described above, the image information displayed in the finished image display area 80 in the operating panel 76 may combine finished images of the available menu selections and other information related to the menu selections (e.g., cooking time and calories) so that overall menu selection will be available for the user in consideration of all the informations provided.

Furthermore, the menu selection procedure of the present invention shall not be limited to that described hereinabove.

As will be known from the above description, because a first embodiment of the invention has a control unit comprised of a liquid crystal display and a transparent electrode switch sheet overlaid together such that one display area of the liquid crystal display and the transparent electrode switch on the transparent electrode switch sheet occupying the same position as said display area form one of the keys on the operation panel of the control unit, the user can select a desired menu choice with an extremely simple operation by operating the keys according to the character information or image information appropriately displayed as the cooking information on the keys of the operation panel.

In addition, because a second embodiment of the present invention provides a menu selection mode setting means, operating key display means, and menu selection means in the control unit, and stores cooking information comprising at least the menu selection mode name, menu names, and material images in the memory, and assigns at least an operation key and selection keys in the keys, the menu selection mode can be electively selected from a menu name listing selection mode and a material specification selection mode by operating the operation key.

Therefore, when the menu to be prepared is undecided or the user is unfamiliar with the available menu choices, the desired menu can be easily selected by setting the menu selection mode to the material specification selection mode. On the other hand, when the user wishes to select a known menu, the known menu can be easily selected by setting the menu selection mode to the menu name listing selection mode and selecting the desired menu based on the menu names displayed in the selection keys.

In addition, because a microwave oven according to a third embodiment of the present invention includes finished images of each menu selection in the cooking information stored in the memory in a microwave oven according to the second embodiment of the invention, and the key display means integrates the mutually adjacent plural keys into a single finished image display area to display a finished image of the menu selection when a specific menu selection is made by the menu selection means, the display more effectively stimulates the appetite of the user for the displayed menu selection, thereby improving menu selectability.

A microwave oven according to a fourth embodiment of the present invention stores in an external storage means cooking information consisting of at least the menu selection mode names, menu names, and material images to be stored in a memory, and transfers the cooking information in the external storage means to the corresponding address in the memory by means of a cooking information transfer means when the external storage means is loaded into the drive of the control unit. Therefore, for example, if the cooking information is stored in the external storage means by cooking category, the materials images used for all menus associated with the cooking category can be displayed on the selection key even if there is a great change in the materials to be used due to a significant change in the cooking category.

Thus, the images of the materials selected by the selection keys are displayed on the selection keys not by illustrations printed thereon but by means of selectively displayable images. A given selection key can therefore be assigned to a variety of materials, and the appropriate materials can be without exception selected in the material specification menu selection mode even if the cooking category is changed significantly.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A microwave oven including a control unit having a first memory to control heat cooking process according to a cooking program for a menu name selected based on cooking information stored in a second memory, said cooking information additionally including menu name selection mode data, menu names and materials image data including character data and image data and wherein said control unit comprises:

a liquid crystal display which is responsive to said character data or image data stored in said second memory for generating a display from a plurality of adjoining discrete display areas;

said display areas being formed by a transparent electrode switch sheet which overlays and is laminated with the liquid crystal display and comprises a respective plurality of transparent electrode switches located at positions corresponding to said plurality of display areas, said display areas of said liquid crystal display and said transparent electrode switch sheet forming a plurality of operator selectable keys spanning the entire surface of an operating panel, said keys being respectively formed at each of said display areas and comprising at least one operation key for selecting a first and a second menu selection modes and a plurality of keys for selecting a menu name or materials;

a menu selection mode setting means for said first and second menu selection modes which change, based on display contents of the display area associated with said operation key when operated, said first menu selection mode comprising a menu name listing selecting mode wherein a menu is selected by referring to a menu name list to find a desired menu and said second menu selection mode comprising a material specification selection mode wherein a menu is selected by specifying predetermined materials used in said desired menu;

a key display means which, when the first selection mode is set by the menu selection mode setting means, displays the menu names stored in the second memory at predetermined display areas associated with said plurality of keys for selecting a menu name or materials, and displays at the display area associated with said at least one operation key a menu selection mode name associated with said first selection mode, and when the second selection mode is set by the menu selection mode setting means, said key display means displays illustrations of available material choices at the display areas at said plurality of keys for selecting a menu name or materials, and displays at the display area associated with said at least one operation key a menu selection mode name associated with the second menu selection mode; and a menu selection means which selects a specified menu name from among the menu names stored in said second memory based on the menu name displayed on a said key for selecting a menu name or materials operated by the user when the first menu selection mode is set by the menu selection mode setting means, and on material illustrations displayed on said keys for selecting a menu name or materials operated by the user when the second menu selection mode is set thereby.

2. The microwave oven according to claim 1 wherein the cooking information stored in the second memory includes finished data of each menu; and wherein said key display means generates a single enlarged composite finished image of a selected menu at a plurality of mutually adjacent display areas respectively associated with said plurality of keys for selecting a menu name or materials when said desired menu is selected by said menu selection means, and reads said finished image to said plurality of mutually adjacent display areas.

3. A microwave oven according to claim 2 further comprising an external storage means in which said cooking information is stored for being down loaded to said second memory, and wherein the control unit further includes:

a loading portion into which is loaded the external storage means; and a cooking information transfer means which transfers the cooking information stored in the external storage means to the corresponding area in said second memory when the external storage means is loaded into the loading portion of the control unit.

4. The microwave oven according to claim 2, wherein the control unit forms the display area of the liquid crystal display across a complete width of the operating panel, and the side of the operating panel forms part of the contour of the microwave oven.

5. The microwave oven according to claim 2 wherein said finished image is generated at all of said keys for selecting a menu name or materials.

6. The microwave oven according to claim 2 wherein said plurality of display areas are formed in at least two adjoining rows of contiguous display areas spanning the entire width of the oven.

7. The microwave oven according to claim 6 wherein a majority of said display areas in said adjoining rows comprise menu and material display areas which convert to said single enlarged composite image of the finished image of the selected menu when a menu is selected via said first and second menu selection modes.

8. The microwave oven according to claim 7 wherein the remainder of said display areas in said adjoining rows comprise display areas for displaying predetermined subsequent selectable operational modes and functions.

9. The microwave oven according to claim 8 wherein said control unit comprises an elongated rectangular unit located in a top front portion of the oven above an oven access door.

* * * * *